US005886669A

United States Patent [19]

Kita

[11] Patent Number: 5,886,669

[45] Date of Patent: Mar. 23, 1999

[54] ANTENNA FOR USE WITH A PORTABLE RADIO APPARATUS

[75] Inventor: Kazunori Kita, Tokyo, Japan

[73] Assignee: Casio Computer Co., Ltd., Tokyo, Japan

[21] Appl. No.: 649,854

[22] Filed: May 3, 1996

[30] Foreign Application Priority Data

| | | | |
|---|---|---|---|
| May 10, 1995 | [JP] | Japan | 7-136010 |
| May 10, 1995 | [JP] | Japan | 7-136011 |
| Jul. 20, 1995 | [JP] | Japan | 7-207844 |

[51] Int. Cl.[6] ..... H01Q 1/38

[52] U.S. Cl. ..... 343/718; 343/700 MS; 343/803; 343/818

[58] Field of Search ..... 343/718, 700 MS, 343/702, 795, 803, 833, 834, 818, 819, 873; H01Q 1/38

[56] References Cited

U.S. PATENT DOCUMENTS

| | | | |
|---|---|---|---|
| 4,754,285 | 6/1988 | Robitaille | 343/718 |
| 4,827,271 | 5/1989 | Berneking et al. | 343/846 |
| 4,922,260 | 5/1990 | Gaskill et al. | 343/718 |
| 5,136,303 | 8/1992 | Cho et al. | 343/718 |
| 5,243,356 | 9/1993 | Hama | 343/718 |
| 5,317,326 | 5/1994 | Tay et al. | 343/718 |
| 5,386,214 | 1/1995 | Sugawara | 343/700 MS |
| 5,465,098 | 11/1995 | Fujisawa et al. | 343/718 |

FOREIGN PATENT DOCUMENTS

| | | | |
|---|---|---|---|
| 2138384 | 10/1982 | Germany | 343/700 MS |

*Primary Examiner*—Michael C. Wimer
*Attorney, Agent, or Firm*—Frishauf, Holtz, Goodman, Langer & Chick

[57] ABSTRACT

An antenna for use in a portable radio apparatus, which has a pair of bands extending from the main body of the apparatus, for securing the apparatus to a user. A first antenna conductor supplied with power and a second antenna conductor not supplied with power are embedded in each band and extend parallel to the axis of the band. The first and second antenna conductors embedded in the first band are connected at one end to the first and second antenna conductors embedded in the second band. No load is connected to the second antenna conductor embedded in each band. The second antenna conductor embedded in each band performs different functions according to its length. If it has a length equal to or greater than half the wavelength λ of waves to receive, it will function as a reflector. If it has a length less than half the wavelength λ of the waves, it will function as a director. The four antenna conductors are adjusted in length and position, constituting an antenna which has high sensitivity and which is small enough to be incorporated into a portable radio apparatus.

13 Claims, 33 Drawing Sheets

FIG.17A
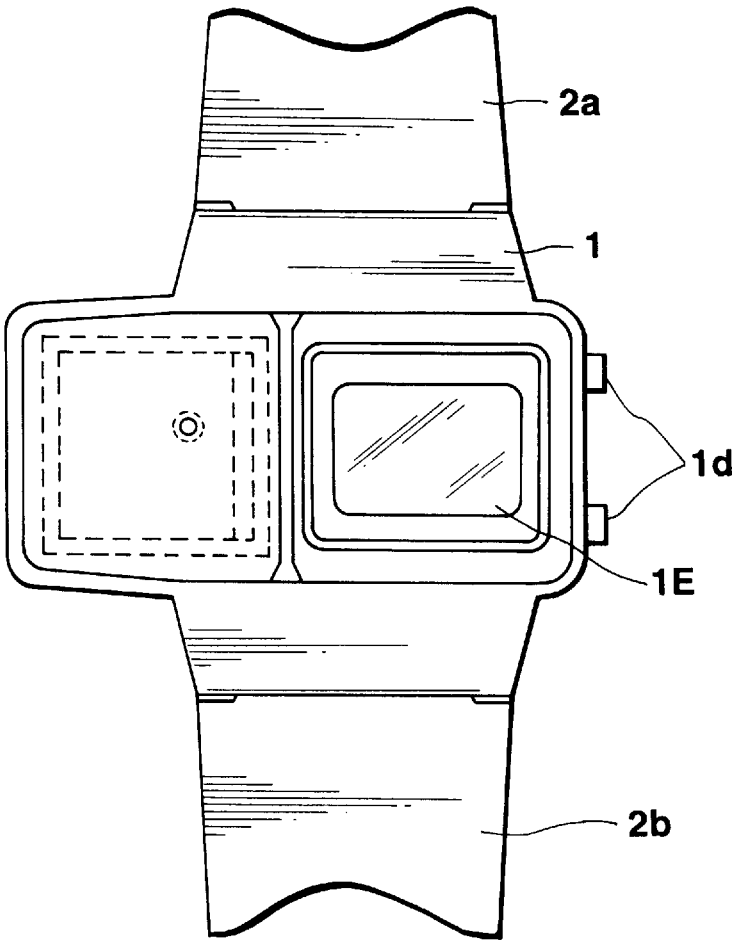
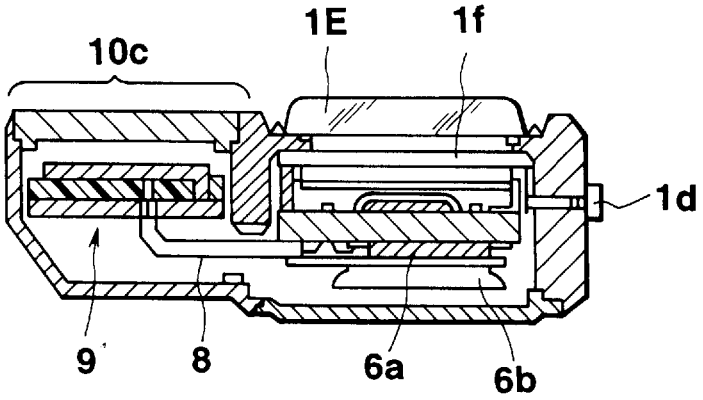
FIG.17B

FIG.18A
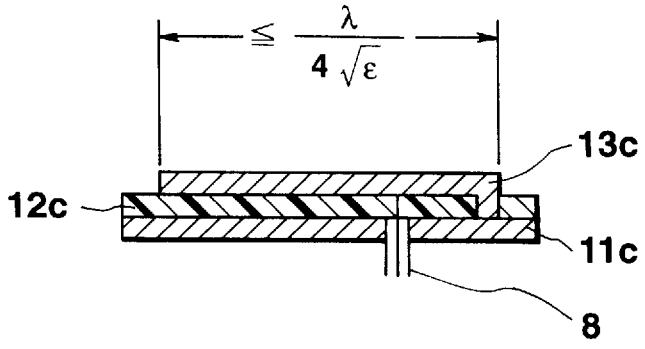
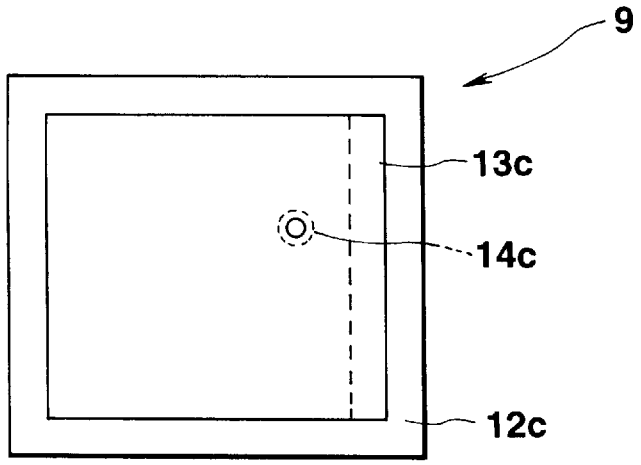
FIG.18B $$2a = \frac{\lambda}{2\sqrt{\varepsilon}}$$

ANTENNA FOR USE WITH A PORTABLE RADIO APPARATUS

BACKGROUND OF THE INVENTION

1. Field of the Invention

The present invention relates to an antenna for use in a portable radio apparatus and, more particularly, to an antenna which is to be incorporated in the housing of a radio apparatus or in a peripheral device to the radio apparatus.

2. Description of the Prior Art

Portable radio apparatuses of various types, such as portable radio receivers and pagers, are commercially available. They are used in great numbers because they are small, light and useful. They have an antenna to receive radio waves. In most cases, the antenna is provided in the housing of the apparatus or in a peripheral device to the apparatus.

The recent advancement in the integrated circuit technology has provided miniaturized components of radio-circuit components which consume but a little power. Additionally, small, high-performance and large-capacity dry cells and rechargeable batteries for use in portable radio apparatuses have come into practical use. However, antennas for use in portable radio apparatuses have yet to be miniaturized. This is because the power an antenna can output is proportional to the wave-receiving area of the antenna and the length of the antenna. It should be noted that the antenna length is closely related to the lengths of radio waves to detect.

Among portable radio apparatuses hitherto developed is a watch-shaped one which comprises a case and a band. If it is an AM radio, it has a bar antenna provided within the case, for receiving MF (Middle-Frequency) radio waves. If it is an FM radio or a pager, it has a loop-type band antenna incorporated in the band, for receiving FM (Frequency-Modulated) radio waves. A portable FM radio receiver and a pager, i.e., two other types of portable radio apparatus, have a cord-type antenna which functions as an earphone, as well.

Conventional antennas, such as a bar antenna, a cord-type antenna and a loop-type band antenna, for use in portable radio apparatuses, are disadvantageous in the following respects.

(a) The bar antenna or the like to be set within the case of a watch-shaped radio apparatus cannot perform a desired function if used in combination with a pager, a mobile telephone or a personal digital assistance (PDA) having a radio receiver/transmitter, which needs to receive high-frequency radio waves of hundreds of megahertzes to several gigahertzes. Further, in order to accommodate the bar antenna or the like, the case must be made of electrically conductive material such as metal.

(b) The cord-type antenna for use in a portable FM radio receiver, which functions also as an earphone, has to be connected to or wrapped around the receiver when it is used.

(c) The loop-type band antenna has a complex structure, and the manufacturing cost of its antenna section is high. This is because a loop must be formed when the antenna is connected to the buckle of the wrist band. Since the antenna is wrapped around the wrist, the diameter of the loop changes with the size of the wrist, inevitably changing the antenna length. To maintain the characteristics of the antenna, an adjusting circuit must be used to compensate for the change in the antenna length.

(d) Even if a metal conductor is bonded to the band of the watch-shaped radio apparatus, the characteristics of the antenna remain unstable. This is because the size of the antenna is limited and also because the conductor or the wrist, which is also a conductor, extends through the antenna loop. As a consequence, the antenna cannot have a sensitivity as high as desired and cannot receive or transmit radio waves reliably.

(e) Generally, the ratio of the radiation resistance to the input resistance is small in the loop antenna. Further, the loop antenna cannot be used unless the input reactance is canceled out. It has be used at an extremely low efficiency.

SUMMARY OF THE INVENTION

Accordingly it is the object of the present invention to provide an antenna for use in a portable radio apparatus, which can be used as a radio apparatus using high-frequency waves of ultrashort-wave band or a higher band, which can be manufactured at low cost and which has good characteristics to increase the sensitivity, efficiency and stability of the radio apparatus. To achieve the above object, one aspect of the invention is directed to a band antenna for use in a portable radio apparatus. The band antenna includes a main body provided with a radio wave circuit, and first flexible power-fed antenna element conductors symmetrically arranged with respect to the main body and fed with power from the main body such that current distributions flowing along the length direction thereof are symmetrical with respect to the main body. Second flexible power-fed antenna element conductors are symmetrically arranged with respect to the main body and fed with power from the main body such that current distributions flowing along the length direction thereof are symmetrical with respect to the main body. A band section is provided with a buckle and holes for securing the apparatus to a user. The first and second flexible power-fed antenna element conductors are embedded in the band section such that the holes are between the first and second flexible power-fed antenna element conductors.

Having this specific structure, the antenna can be very portable, can reliably receive radio waves of various frequencies and can yet be manufactured at low cost.

BRIEF DESCRIPTION OF THE DRAWINGS

FIG. 17A is a front view and FIG. 17B is a sectional view of a watch-shaped radio apparatus equipped with a patch antenna which is a seventh embodiment of the present invention;

FIG. 18A is a front view and FIG. 18B is a sectional view of the patch antenna according to the seventh embodiment;

DETAILED DESCRIPTION OF THE PREFERRED EMBODIMENTS

Embodiments of the present invention will be described, with reference to the accompanying drawings. The embodiments are designed for use in watch-shaped portable radio apparatuses.

First Embodiment

1. Structure

Figure 1A:
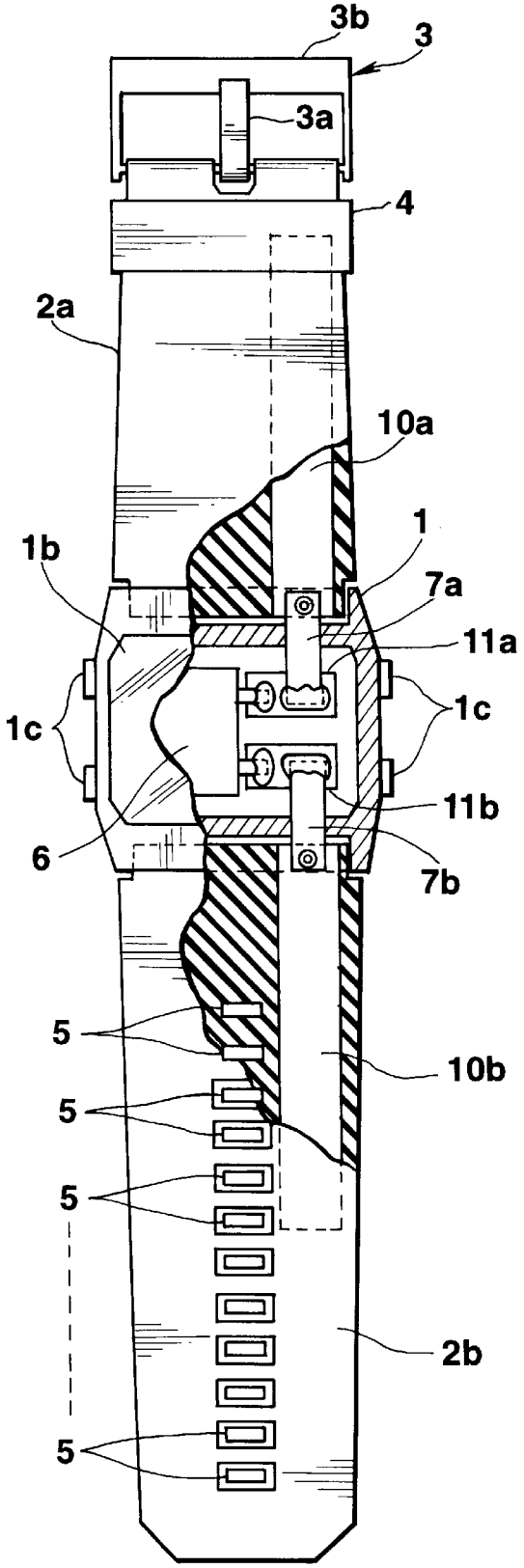
FIGS. 1A and 1B are a front view and sectional view of a watch-shaped radio apparatus equipped with an antenna according to a first embodiment of the present invention.
Figure 1B:
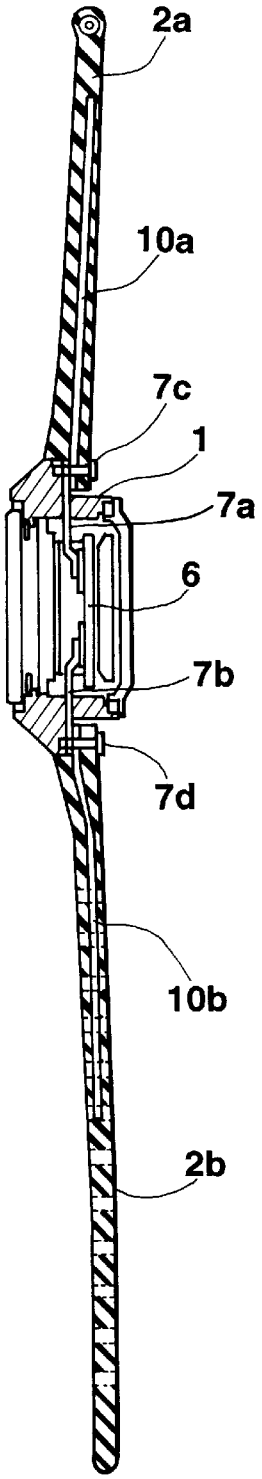

FIG. 1A is a front view of a watch-shaped radio apparatus equipped with a band antenna which is the first embodiment of the present invention. FIG. 1B is a sectional view of the watch-shaped radio apparatus. As shown in FIG. 1A, the radio apparatus comprises a main body 1, two band sections 2*a* and 2*b*, and a buckle section 3. The main body 1 contains electronic components which perform watch function and radio-apparatus function. The band sections 2*a* and 2*b* are connected to the main body 1 to secure the main body 1 to a user's wrist. The buckle section 3 fastened to the free end of the band section 2*a*. The main body 1 has a display 1*b* which is an LCD or the like, on its upper surface. On its each side the main body 1 has two switches 1*c*.

A ring 4 is mounted on the band section 2*a*. Into this ring 4 the user inserts the other band section 2*b* when he or she wraps both band section 2*a* and 2*b* around the wrist to wear the watch-shaped radio apparatus. The band section 2*b* has a row of holes 5. The buckle section 3 has a pin 3*a* and a decorative ring 3*b*. The user inserts the pin 3*a* into one of the holes 5 to secure the radio apparatus on his or her wrist. The pin 3*a* remains in contact with the decorative ring 3*b* as long as the user wears the watch-shaped radio apparatus.

The main body 1 contains a radio circuit section 6 and conductive power-supply terminals 7*a* and 7*b*. The radio circuit section 6 is designed to supply power to antenna conductors 10*a* and 10*b*, which will be described later. An input/output terminal projects from the section 6, for supplying to the section 6 the power the antenna conductors 10*a* and 10*b* have received. The input/output terminal is connected to conducive bases 11*a* and 11*b*, both electrically and physically. The power-supply terminals 7*a* and 7*b* extend in the axial direction of the band section 2*a* and 2*b*. They are connected at one end to the base 11*a* and 11*b*, respectively, both electrically and physically by, for example, solder.

In the band section 2*a*, the other end of the power supply terminal 7*a* is electrically and physically secured by a conductive screw 7*c* to one end of the antenna conductor 10*a* which extends in the axial direction of the band section 2*a*. In the band section 2*b*, the other end of the power supply terminal 7*b* is electrically and physically secured by a conductive screw 7*d* to one end of the antenna conductor 10*b* which extends in the axial direction of the band section 2*b*. The antenna conductors 10*a* and 10*b* are metal strips, thin metal strips or wires, which are flexible members. The power-supply terminal 7*a* is provided between the main body 1 and the band section 2*a*, and the power-supply terminal 7*b* between the main body 1 and the band section 2*b*. Both power-supply terminals 7*a* and 7*b* are made of flexible material, allowing the sections 2*a* and 2*b* to move with respect to the main body 1.

2. Electrical Characteristics

Figure 2A:
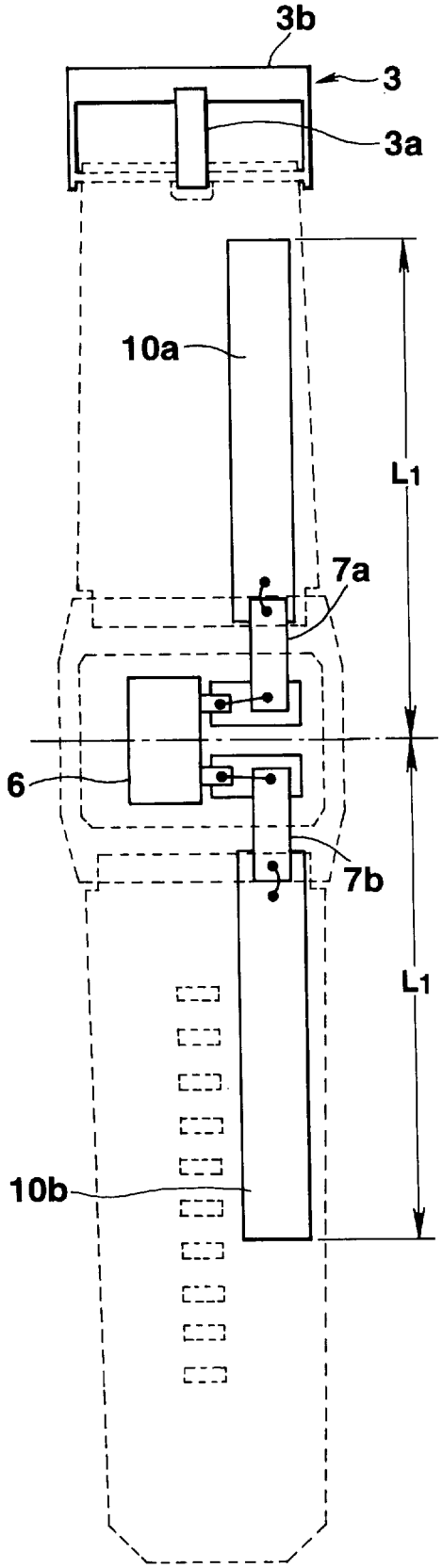
FIGS. 2A and 2B are, respectively, a diagram showing the antenna and an equivalent circuit diagram thereof, respectively.
Figure 2B:
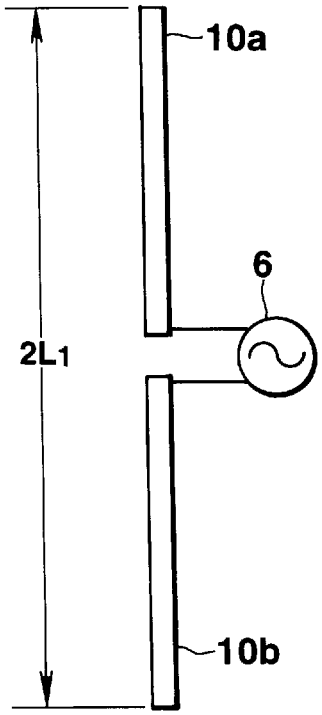

FIG. 2A is a schematic representation of the above-mentioned band antenna, and FIG. 2B is an equivalent circuit diagram of the band antenna. As shown in FIG. 2A, the band antenna has an antenna length L1 which is the sum of the length of the power-supply terminal 7*a* and that of the antenna conductor 10*a*. The antenna length L2 is given as:

$$2L_1 = \frac{\lambda}{2} \tag{1}$$

$$\therefore L_1 = \frac{\lambda}{4} \quad (\lambda\text{: wavelength})$$

The band antenna is therefore identical in structure to a so-called "half-wave dipole antenna", which will be hereinafter referred to as "half-wave antenna." Most half-wave antennas are omnidirectional in two planes which are symmetrical with respect to the antenna axis and which are located at the same distance from the antenna axis. The input impedance of a half-wave antenna is expressed as follows:

$$\begin{aligned} Z_{2L} = \left(\frac{\lambda}{2} + \Delta\right) &\cong 73.13 + j42.55 + jWek\Delta\ (\Omega) \\ &\cong 73.13 + j42.55 + \underline{j60 \cdot \ln(2L/\rho)}\ (\Omega) \\ &\downarrow \\ &\left(\begin{array}{l} \text{or } j60 \cdot \log_e(2L/\rho) \\ \cong j138 \cdot \log_{10}(2L/\rho) \end{array}\right) \end{aligned} \tag{2}$$

where 2L (=2L1) is the total antenna length, ρ is the diameter of either antenna conductor, k=2π/λ, λ is the wavelength, and We is the wave impedance. The resistance R of the half-wave antenna is substantially proportional to the square of the total length 2L (=λ/2). That is, the less the total length 2L, the lower the resistance R. Hence, the input reactance X of the antenna changes almost linearly with the total length 2L. The greater the diameter ρ of the antenna conductors, the greater the input reactance X, provided that the total length 2L is relatively small. Generally, it is desirable that the input impedance of the half-wave antenna be almost the same as forward resistance. To make the input impedance as nearly equal to the forward resistance, it is required, as can be understood from the equation (2), that the total length 2L be a little less than half-wave length Eλ/2. In other words, it suffices to set the half antenna-length L (=L1) at 0.90 to 0.95 times λ/4.

The radiation power Wr of the half-wave antenna is defined as follows:

$$\begin{aligned} Wr &\cong 60|I|^2 \int_0^{\pi} \frac{\cos^2\left(\frac{\pi}{2}\cos\theta\right)}{\sin\theta}\, d\theta \\ &= 30|I|^2 (\gamma + \ln 2_\pi - Ci2_\pi) \\ &= 30|I|^2 \times 2.44\ldots \\ &\cong 73.13|I|^2 (W) \end{aligned} \tag{3}$$

$$\left(\begin{array}{l} \gamma\text{: Eiler's constant, } Ci\text{: cosine integtal,} \\ \gamma\text{: } = 0.577\ldots \\ Ci(z) = -\int_z^{\infty} \frac{\cos x}{x}\, dx \end{array}\right)$$

The radiation resistance Rr of the antenna is represented by the following equation:

$$Rr = \frac{Wr}{|I|^2} \cong 73.13\ (\Omega) \tag{4}$$

The directional gain Gd of the antenna is given as:

$$\begin{aligned} Gd &= \frac{1}{\int_0^{\frac{\pi}{2}} \frac{\cos^2\left(\frac{\pi}{2}\cos\theta\right)}{\sin\theta}\, d_\theta} \\ &= \frac{4}{2.44\ldots} = 1.6409\ldots \end{aligned} \tag{5}$$

Second Embodiment

1. Structure

Figure 3A:
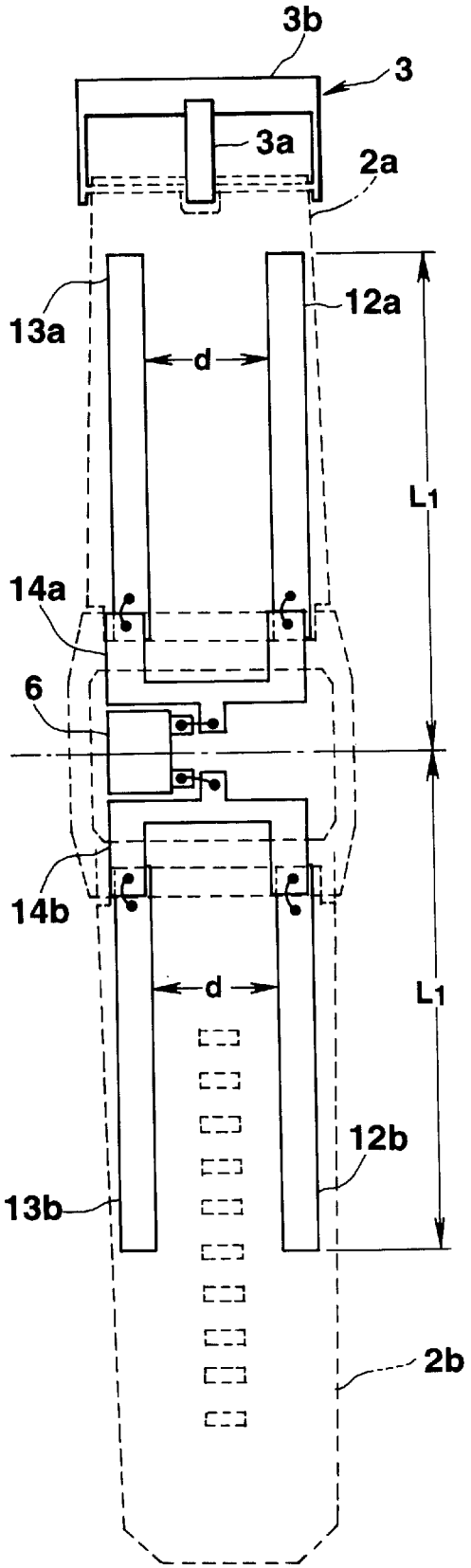
FIGS. 3A and 3B are a diagram showing the antenna according to a second embodiment of the invention and an equivalent circuit diagram thereof, respectively.
Figure 3B:
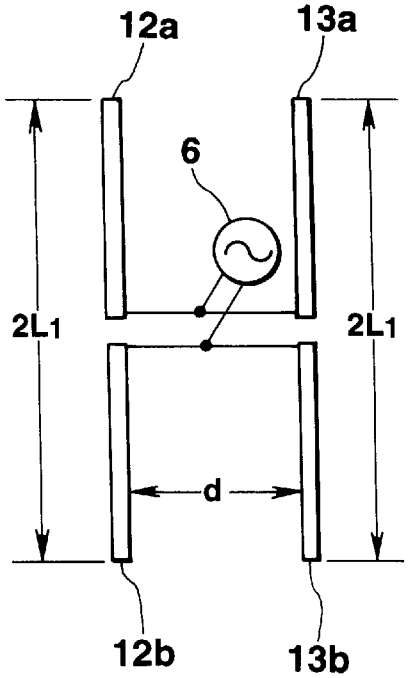

FIG. 3A is a front view of a watch-shaped radio apparatus equipped with a band antenna which is the second embodiment of this invention. FIG. 3B is a sectional view of the watch-shaped radio apparatus. This band antenna A has a plurality half-wave antenna conductors. More precisely, as shown in FIG. 3A, two antenna conductors 12*a* and 13*a* are provided in a band section 2*a*, spaced apart by a distance d and electrically connected by a loop-shaped power-supply terminal 14*a*. Similarly, two antenna conductors 12*b* and 13*b* are provided in a band section 2*b*, spaced apart by a distance d and electrically connected by a U-shaped power-supply terminal 14*b*. The half antenna-length L1 of the second embodiment is the sum of the length of the power-supply terminal (14*a* or 14*b*) and that of the antenna conductor (10*a* or 10*b*).

The second embodiment comprises two identical half-wave antennas which are spaced apart from each other by the distance d. Therefore, the input impedance of the second embodiment is given as:

$$Z_1 = Z_2 = \frac{V_2}{V_1} = Z_{11} + Z_{12} \tag{6}$$

-continued $$\left(\begin{array}{l} Z_{11}\text{: self – impedance of antena 1} \\ Z_{12}\text{: mutual impedance between antennas 1 and 2} \end{array}\right)$$

The mutual impedance Z12 (=R12 +jX12) is represented by the following equation:

$$R_{12} = R_{21} = 30\left[2Ci(kd) - Ci\left\{\sqrt{(kd)^2+\pi^2+\pi}\right\} - Ci\left\{\sqrt{(kd)^2+\pi^2}-\pi\right\}\right](\Omega) \tag{7}$$

$$X_{12} = X_{21} - 30\left[2Si(kd) - Si\left\{\sqrt{(kd)^2+\pi^2}+\pi\right\} - Si\left\{\sqrt{(kd)^2+\pi^2}-\pi\right\}\right](\Omega)$$

$$\left(\begin{array}{l} \text{where,} \\ Ci\text{: cosine integral} \\ Ci(z) = -\int_z^{\infty}\frac{\cos x}{x}\,dx \\ Si(z) = \int_0^{z}\frac{\sin x}{x}\,dx \end{array}\right)$$

In the band antenna of the second embodiment, the mutual impedance Z12 is applied, in series, to the input impedance. To reduce reactance component X12 to zero, that is, to change it into pure resistance, it suffices to satisfy the conditions of d/(λ/4)=0.5 or 2.8, or d=λ/8 or 0.7λ. More simply stated, the antenna conductors 12*a* and 13*a* should be spaced apart, and the antenna conductors 12*b* and 13*b* should be spaced apart, by λ/8 or 0.7λ. In this case, the gain Gh attainable in the maximum radiation direction is:

$$Gh = \frac{|2E_0|^2}{2(R_{11}+R_{12})|I|^2} \Big/ \frac{|E_0|^2}{R_{11}|I|^2} \cong \frac{2\times 73.13}{73.13+R_{12}} \tag{8}$$

Obviously, the gain Gh is 4 to 5 dB greater than the gain Gd of the half-wave antenna of the first embodiment, when the distance d ranges from 2.5 to 3 times λ/4.

Modification of the Second Embodiment

Figure 4A:
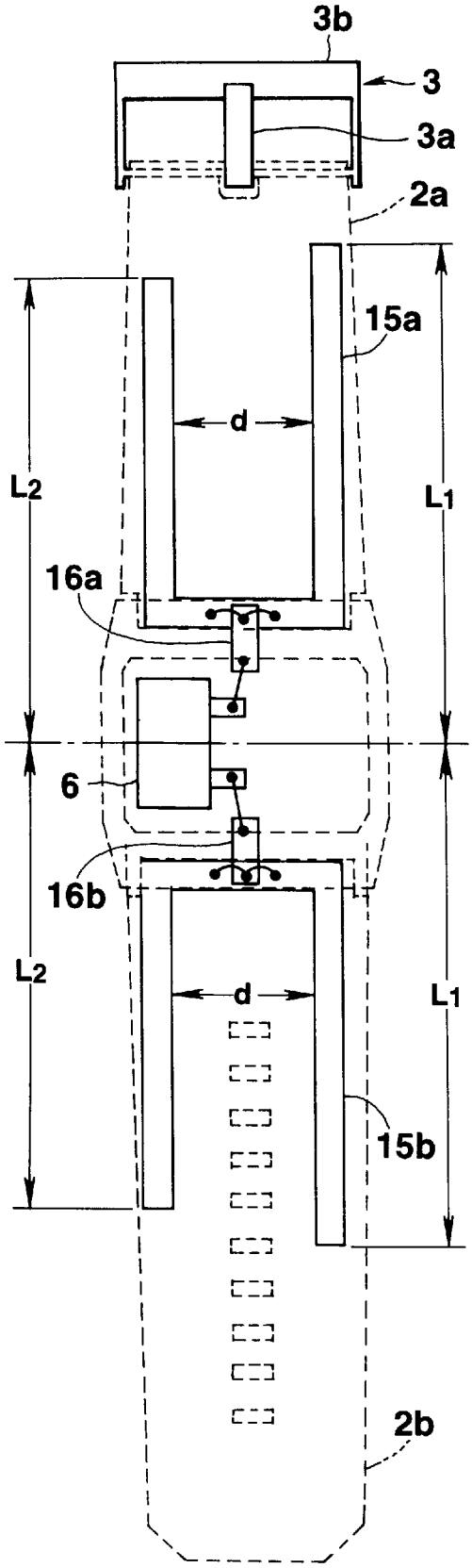
FIGS. 4A and 4B are a diagram illustrating a modification of the antenna shown in FIG. 3A and an equivalent circuit diagram of the modified antenna, respectively.
Figure 4B:
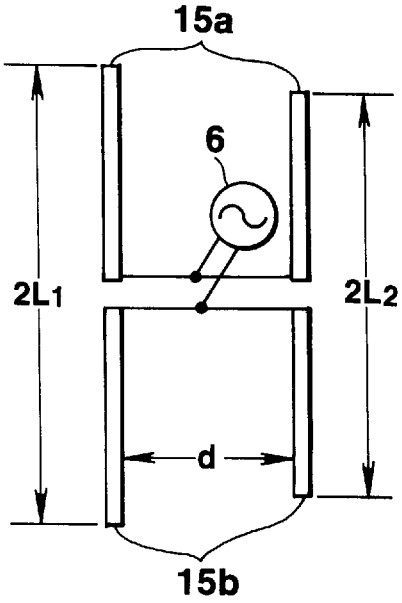

FIG. 4A is a diagram illustrating a modification of the second embodiment shown in FIG. 3A, and FIG. 4B is an equivalent circuit diagram of the modified band antenna. The modified band antenna has two U-shaped antenna conductors 15*a* and 15*b* which are embedded in band sections 2*a* and 2*b*, respectively. The antenna conductors 15*a* and 15*b* extend in the axial direction of the sections 2*a* and 2*b*. They are electrically connected to power-supply terminals 16*a* and 16*b*. Each antenna conductor has two parallel portions which have different lengths L1 and L2 (L1<L2) and which are spaced apart by a distance d. The modified band has characteristics similar to those of the second embodiment shown in FIGS. 3A and 3B.

Third Embodiment

Figure 5A:
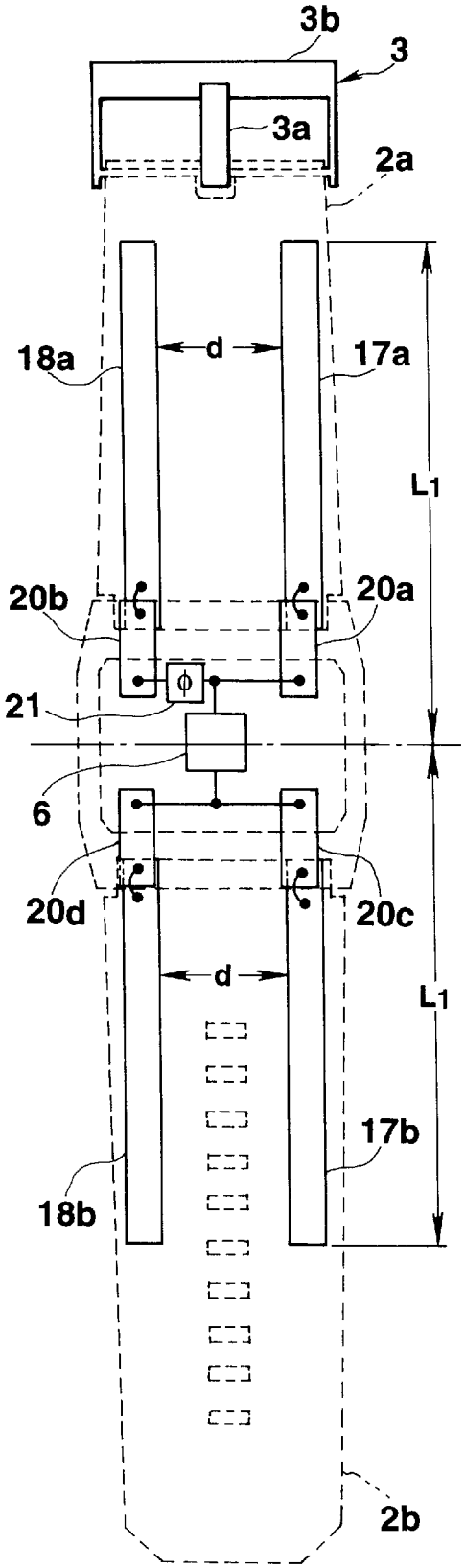
FIGS. 5A, 5B and 5C are a diagram showing an antenna according to a third embodiment of the invention, an equivalent circuit diagram thereof and a schematic diagram thereof, respectively.
Figure 5B:
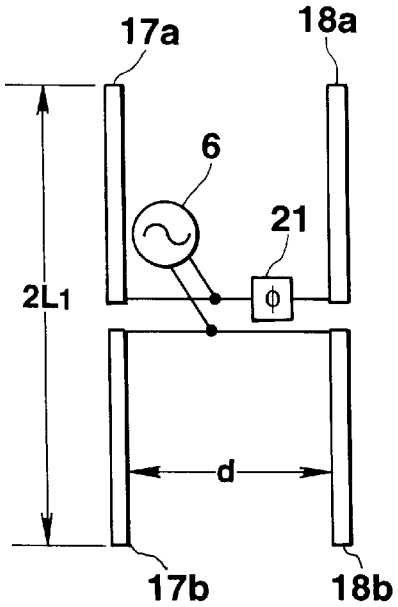
Figure 5C:
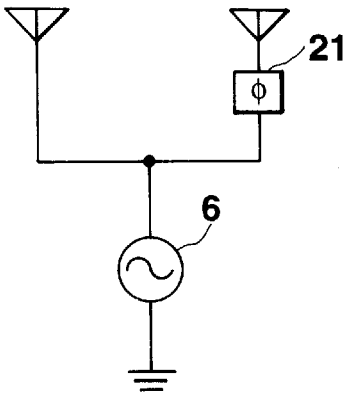

FIG. 5A is a diagram showing a band antenna which is the third embodiment of the invention. FIG. 5B is an equivalent circuit diagram of this band antenna. FIG. 5C is a schematic representation of the band antenna.

As illustrated in FIG. SA, two antenna conductors 17*a* and 18*a* are embedded in a band section 2*a*, are spaced apart by a distance d and extend in the axial direction of the band section 2*a*. Similarly, two antenna conductors 17*b* and 18*b* are embedded in a band section 2*b*, are spaced apart by distance d and extend in the axial direction of the band section 2*b*. The antenna conductors 17*a* and 18*a* are electrically connected to a radio circuit section 6 (i.e., power-supply section) by power-supply terminals 20*a* and 20*b*. The antenna conductors 17*b* and 18*b* are electrically connected to a radio circuit section 6, too, by power-supply terminals 20*c* and 20*d*. A phase shifter 21 is provided on the line connecting the power-supply terminal 20*b* to the radio circuit section 6. Due to the phase shifter 21, the conductors 17*a* and 18*a* function as a half-wave antenna which differs in phase from the half-wave antenna constituted by the conductors 17*b* and 18*b*. Thus, even if the distance d is reduced, the band antenna can acquire characteristics as good as those of an antenna in which the distance d ranges 5λ/8 to 3λ/4 and which therefore has a great gain. The third embodiment therefore equals the first and second embodiments in antenna characteristics.

Fourth Embodiment

Figure 6A:
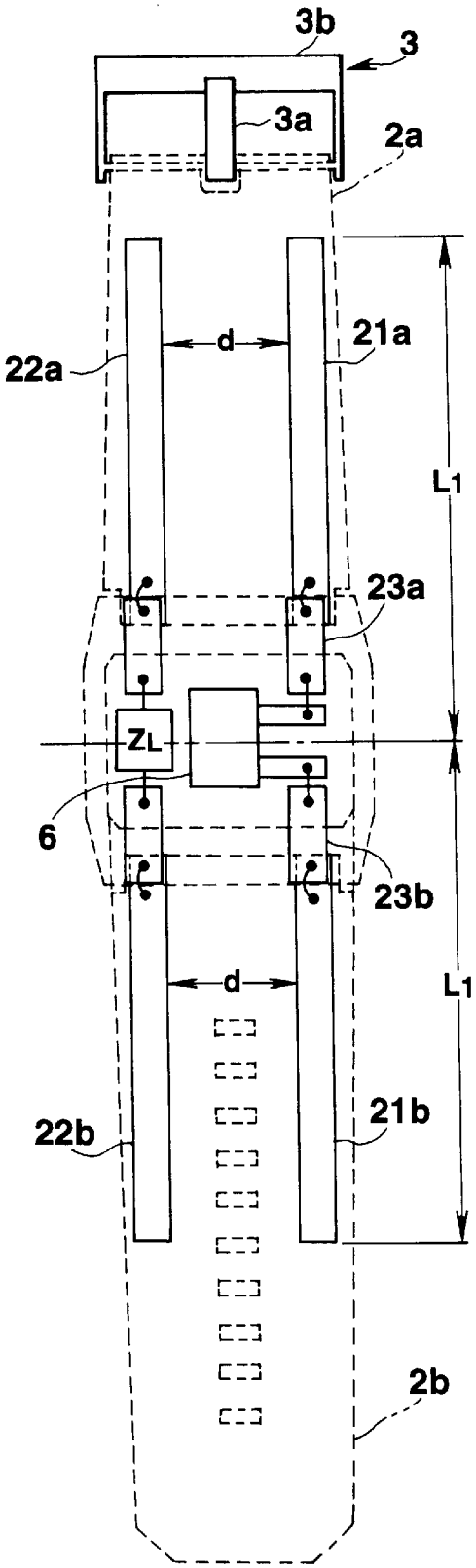
FIGS. 6A and 6B are a diagram representing the antenna according to a fourth embodiment of this invention and an equivalent circuit diagram thereof, respectively.
Figure 6B:
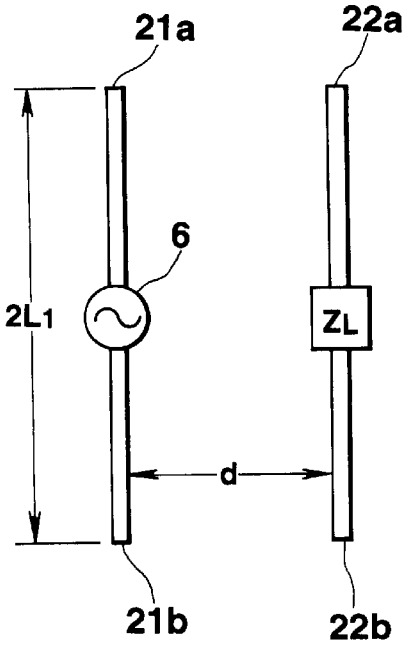

FIG. 6A is a diagram representing the band antenna which is the fourth embodiment of the invention, and FIG. 6B is an equivalent circuit diagram of the band antenna. As seen from FIG. 6A, antenna conductors 21*a* and 22*a* are embedded in a band section 2*a* and extend in the axial direction of the section 2*a*. Also, antenna conductors 21*b* and 22*b* are embedded in a band section 2*b* and extend in the axial direction of the section 2*b*. Of the four antenna conductors, only the conductors 21*a* and 21*b* are electrically connected to a radio circuit section 6 (i.e., power-supply section) by power-supply terminals 23*a* and 23*b*, respectively. The other conductors 22*a* and 22*b* are connected in series to each other by a load ZL. The conductor 22*a* is spaced from the conductor 21*a* by a distance d, and the conductor 22*b* from the conductor 21*a* by the same distance d. An intense electric field is generated in the vicinity of the conductors 21*a* and 21*b* when power is supplied to these conductors 21*a* and 21*b*. As a result, a current flows through the conductors 22*a* and 22*b* located near the conductors 21*a* and 21*b*, though power is supplied to neither the conductor 22*a* nor the conductor 22*b*. The conductors 22*a* and 22*b* therefore function as antenna conductors. To be more precise, they operate as reflectors or directors.

The input impedance the entire antenna has, i.e., the input impedance at the antenna conductors 21*a* and 21*b*, is expressed by the following equation:

$$Z = Z_{11} - \frac{Z_{12}^2}{Z_{22}+Z_L} \tag{9}$$

The gain Gh (θ, φ) of the half-wave antenna comprised of antenna conductors 21*a* and 21*b* is defined by the following equation:

$$Gh(\theta,\phi) = \frac{R_0}{R}\left|1 - \frac{Z_{22}e^{jkd\sin\theta\cos\phi}}{Z_{22}+Z_L}\right|^2 \frac{\cos^2\left(\frac{\pi}{2}\cos\theta\right)}{\sin^2\theta} \tag{10}$$

where $R_0$ is the radiation resistance of the half-wave antenna, given as follows.

$$R_0 = \frac{Wr}{|I|^2} \cong 73.13\ (\Omega)$$

As can be understood from the equation (10), the input impedance and gain of the half-wave antenna can be changed by adjusting the load ZL connected between the antenna conductors 22*a* and 22*b* to which no power is supplied. If the load ZL is adjusted, thus increasing the gain in the direction where $\phi=0$, the antenna conductors 22*a* and 22*b* will work as directors. If the load ZL is adjusted, thereby increasing the gain in the direction where $\phi=80$, the antenna conductors 22*a* and 22*b* will work as reflectors.

First Modification of the Fourth Embodiment

Figure 7A:
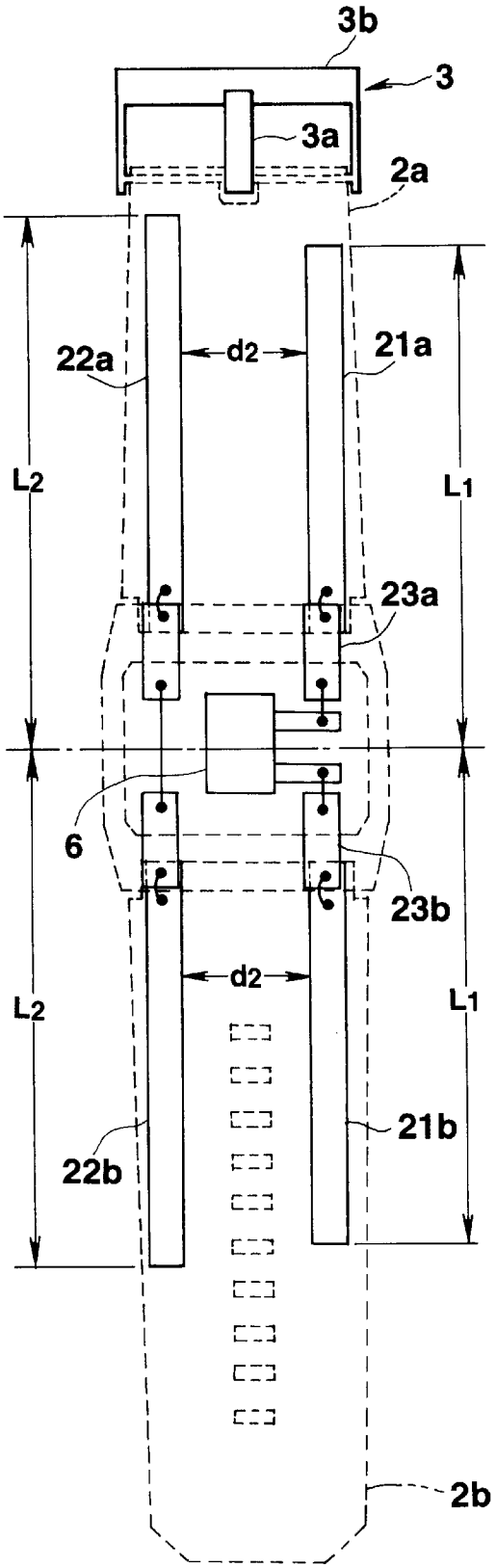
FIGS. 7A and 7B are a diagram illustrating a modification of the antenna shown in FIG. 6A and an equivalent circuit diagram of the modified antenna, respectively.
Figure 7B:
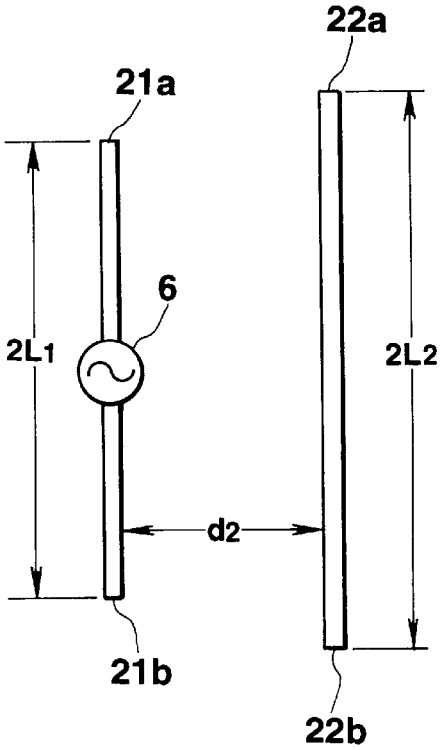

FIG. 7A is a diagram illustrating a first modification of the fourth embodiment, i.e., the band antenna shown in FIG. 6A. FIG. 7B is an equivalent circuit diagram of the first modified band antenna. As shown in FIG. 7A, no load ZL is used in this antenna, short-circuiting antenna conductors 22*a* and 22*b* to which no power is supplied. The conductors 22*a* and 22*b* therefore perform the same function of the reflectors of an antenna known as "Yagi-Uda antenna." In this modified antenna, the antenna conductors 22*a* and 22*b* differ in length from the antenna conductors 21*a* and 21*b*, thereby achieving the same results as can be attained by adjusting the value for the load ZL in the antenna shown in FIGS. 6A and 6B. To be more specific, if the length L2 of the antenna conductors 22*a* and 22*b* are longer or shorter than the antenna conductors 21*a* and 21*b* which constitute a half-wave antenna ($2L1=\lambda/2$, $L1=\lambda/4$), the reactance component of the self-impedance of each of the conductors 22*a* and 22*b*, the total length of which nearly equals the half-wave length $\lambda/2$, changes greatly, while the resistance component of the self-impedance changes a little. Hence, the change in the length L2 of the conductors 22*a* and 22*b* results in a change in the reactance X22 only.

If their length L2 is equal to or greater than $\lambda/4$ ($2L2=\lambda/2$), the antenna conductors 22*a* and 22*b* will operate as reflectors, and the axial gain of the band antenna will decrease about 6 dB. On the other hand, if their length L2 is 0.8 to 0.9 times $\lambda/4$, they will operate as directors, and the axial gain will increase 2 db to 3 dB. The thicker the antenna conductors 22*a* and 22*b*, the shorter they can be to work as directors.

Second Modification of the Fourth Embodiment

Figure 8A:
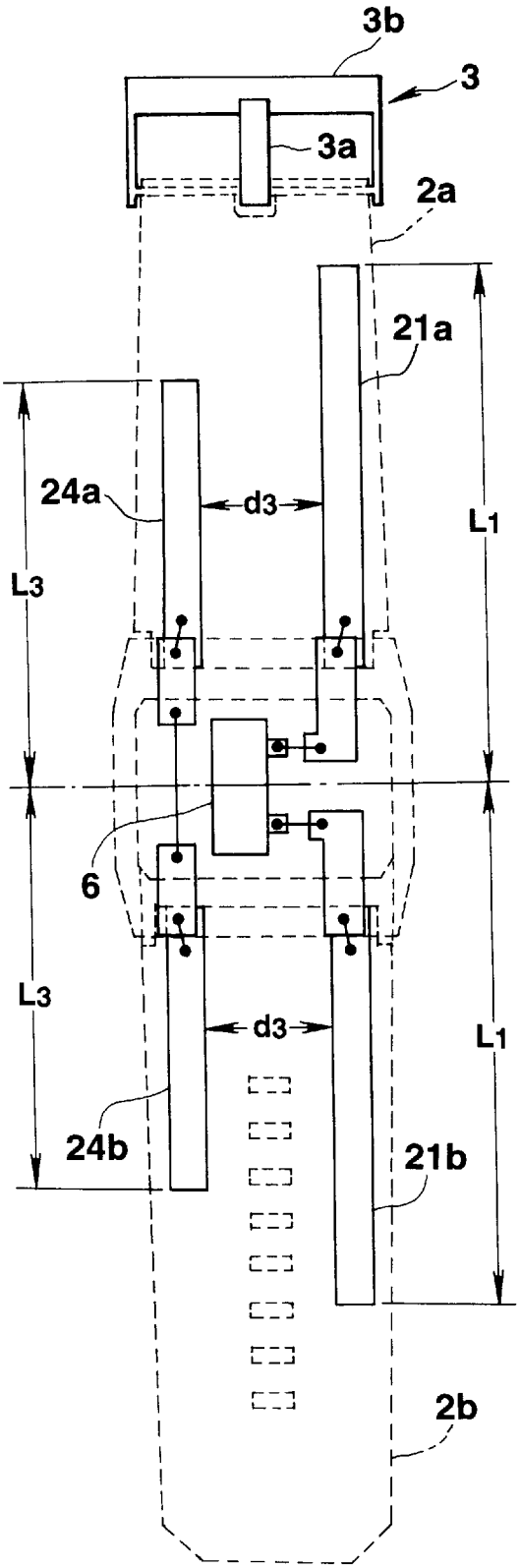
FIGS. 8A and 8B are a diagram showing another modification of the antenna shown in FIG. 6A and an equivalent circuit diagram of this modified antenna, respectively.
Figure 8B:
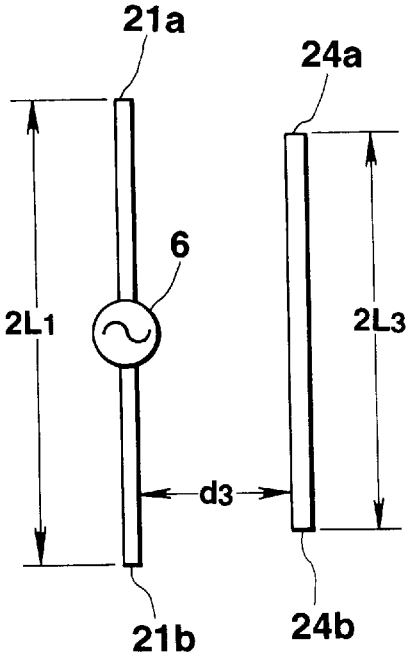

FIG. 8A is a diagram illustrating a second modification of the fourth embodiment, i.e., the band antenna shown in FIGS. 6A and 6B. FIG. 8B is an equivalent circuit diagram of the first modified band antenna. As shown in FIGS. 8A and 8B, antenna conductors 24*a* and 24*b* which are shorter than antenna conductors 21*a* and 21*b* are used, replacing the antenna conductors 22*a* and 22*b* which are longer than the conductors 21*a* and 21*b*. More precisely, the conductors 24*a* and 24*b* have a length L3 which is 0.8 to 0.9 times the length L1 of the conductors 21*a* and 21*b*. The conductors 24*a* and 24*b*, to which no power is supplied, are spaced apart from the conductors 21*a* and 21*b*, respectively, by a distance d3. The antenna conductors 24*a* and 24*b* operate as directors.

Third Modification of the Fourth Embodiment

Figure 9A:
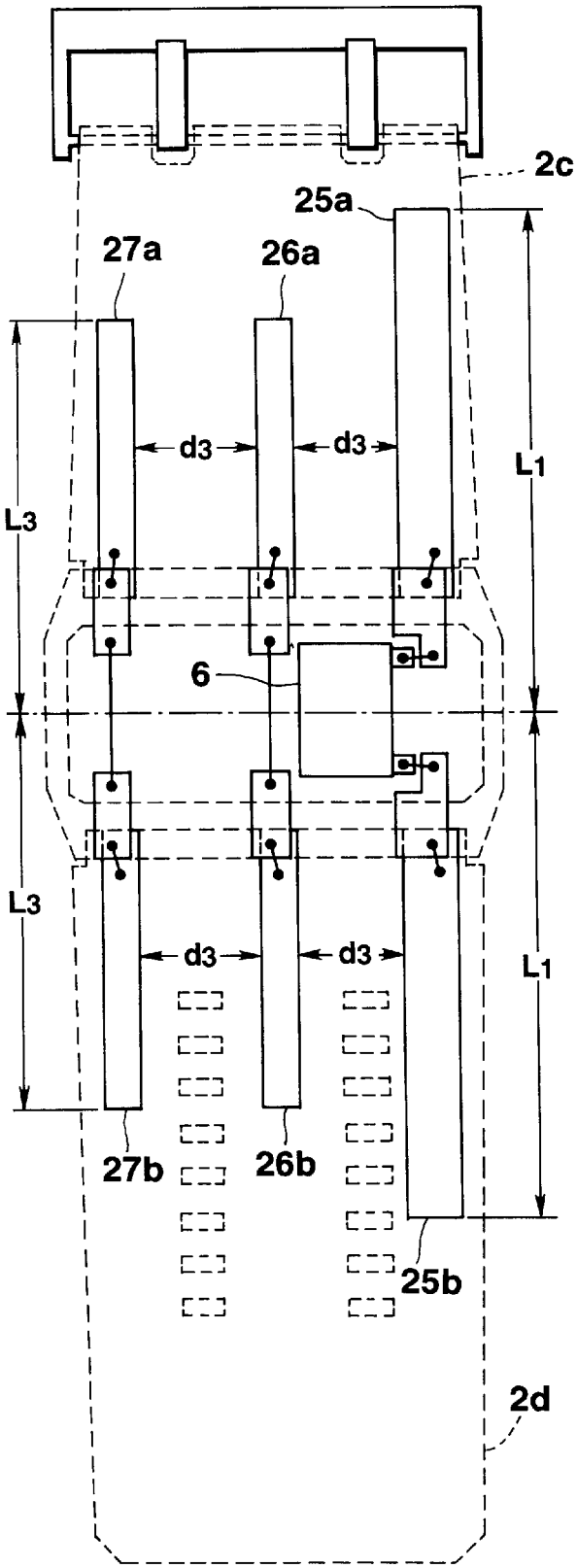
FIGS. 9A and 9B are a diagram illustrating still another modification of the antenna shown in FIG. 6A and an equivalent circuit diagram of this modified antenna, respectively.
Figure 9B:
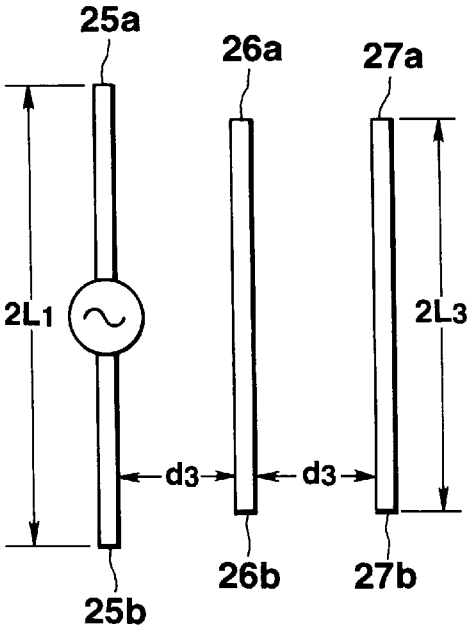

FIG. 9A is a diagram illustrating a third modification of the fourth embodiment, i.e., the band antenna shown in FIGS. 6A and 5B. FIG. 9B is an equivalent circuit diagram of this modified antenna. As seen from in FIG. 8A, band sections 2*c* and 2*d* are provided which are broader than the band sections 2*a* and 2*b* shown in FIG. 6A. The band section 2*d* has two rows of holes. Three antenna conductors 25*a*, 26*a* and 27*a* are embedded in the band section 2*c* and spaced apart by a distance d3. Similarly, three antenna conductors 25*b*, 26*b* and 27*b* are embedded in the band section 2*d* and spaced apart by a distance d3. The conductors 25*a* and 25*b* are connected to a radio circuit section 6 (i.e., power-supply section), constituting a half-wave antenna. No power is supplied to the remaining conductors 26*a*, 26*b*, 27*a* and 27*b*, which operate as directors. To reverse the transmitting (or receiving) directivity of the band antenna while the conductors 26*a*, 26*b*, 27*a* and 27*b* are operating as directors, it suffices to exchange the positions of the conductors 25*a* and 25*b* and the radio circuit section 6 with the positions of the antenna conductors 26*a* and 26*b*.

Fourth Modification of Fourth Embodiment

Figure 10A:
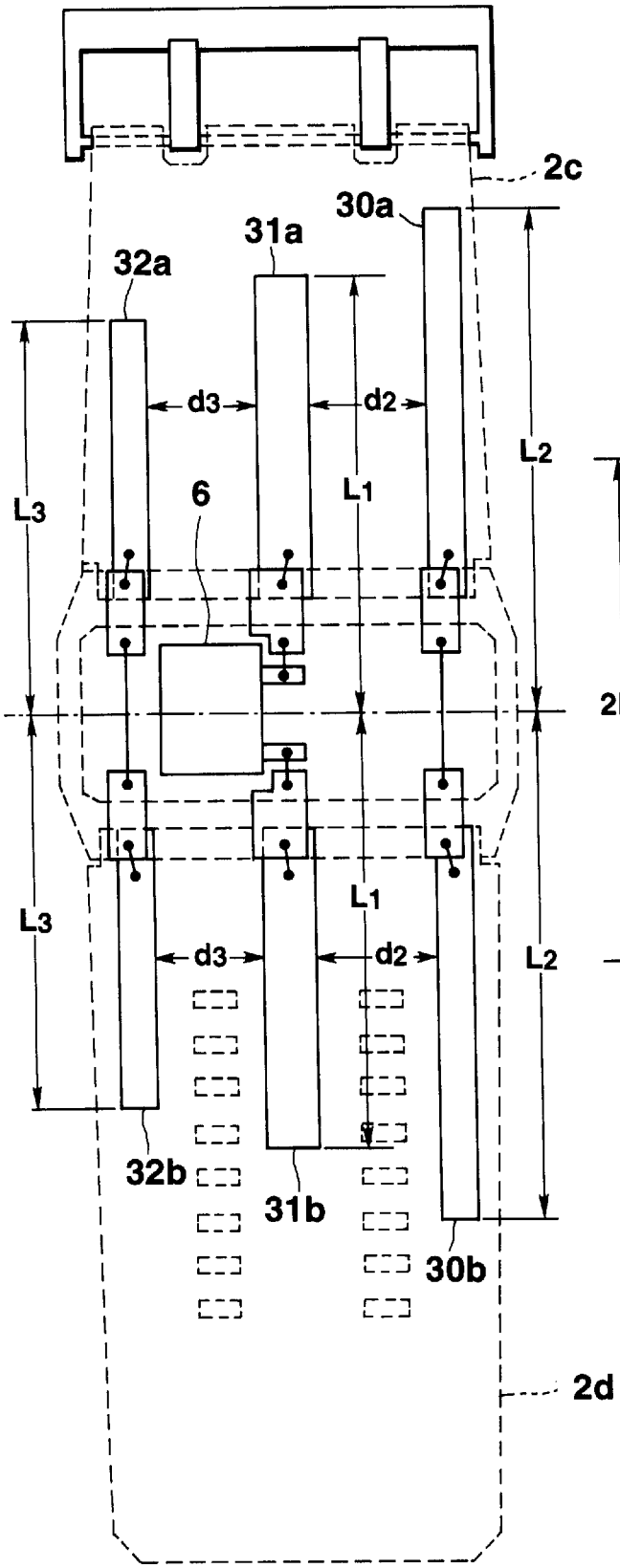
FIGS. 10A and 10B are a diagram showing a further modification of the antenna shown in FIG. 6A and an equivalent circuit diagram of the modified antenna, respectively.
Figure 10B:
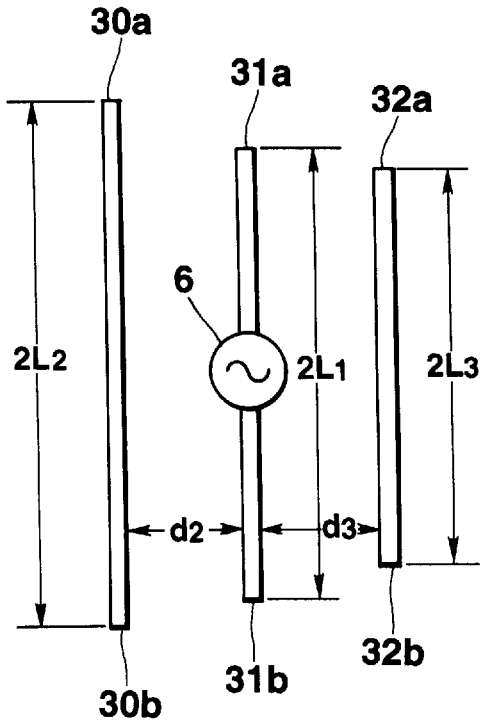

FIG. 10A is a diagram illustrating a fourth modification of the fourth embodiment, i.e., the band antenna shown in FIGS. 6A and 6B. FIG. 10B is an equivalent circuit diagram of the fourth modified antenna. As illustrated in FIG. 10A, three antenna conductors 30*a*, 31*a* and 32*a* are embedded in a band section 2*a*, and three antenna conductors 30*b*, 31*b* and 31*b* in a band section 2*b*. The conductors 31*a* and 31*b*, which have a length L1, are connected to a radio circuit section 6 (i.e., power-supply section), constituting a half-wave antennas. The conductors 30*a* and 30*b* are located near the conductors 31*a* and 31*b*, respectively, spaced apart therefrom by a distance d2. The conductors 32*a* and 32*b* are located near the conductors 31*a* and 31*b*, respectively, spaced apart therefrom by a distance d3.

The antenna conductors 30*a* and 30*b* have an effective length L2 which is greater than the effective length L1 of that of antenna conductors 31*a* and 31*b*. By contrast, the conductors 32*a* and 32*b* have an effective length L3 which is less than the effective length L1 of that of antenna conductors 31*a* and 31*b*. The conductors 20*a* and 30*b* constitute a reflector, whereas the conductors 32*a* and 32*b* constitute a director. The fourth modification is a three-component Yagi-Uda antenna provided in the form of a band antenna. The input impedance and gain of this antenna can be changed by adjusting the distance d3 between the conductors 31*a* and 31*b*, on the one hand, and the conductors 32*a* and 32*b*, on the other, and by adjusting the effective length L3 of the conductors 32*a* and 32*b*. The fourth modification is a three-component (reflector+director+antenna) antenna and has a gain which is 4 to 6 dB greater than that of an ordinary half-wave antenna.

Fifth Embodiment

1. Structure

Figure 11A:
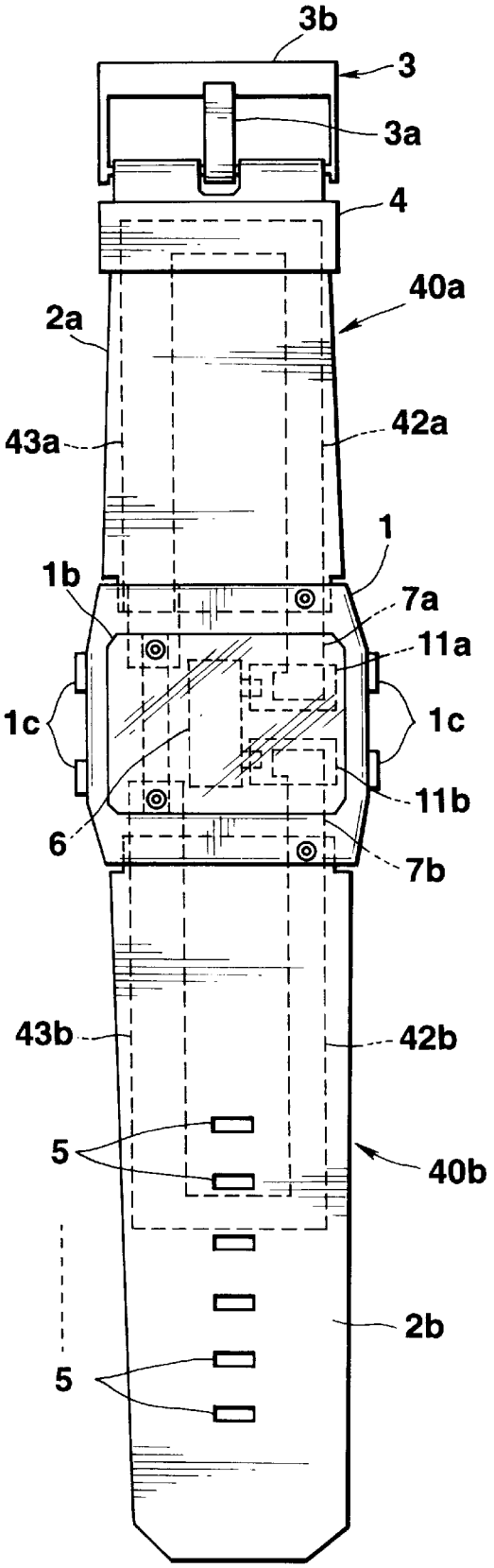
FIGS. 11A and 11B are a front view of a watch-shaped radio apparatus equipped with an antenna which is a fifth embodiment of the invention, and a schematic view of the antenna, respectively.
Figure 11B:
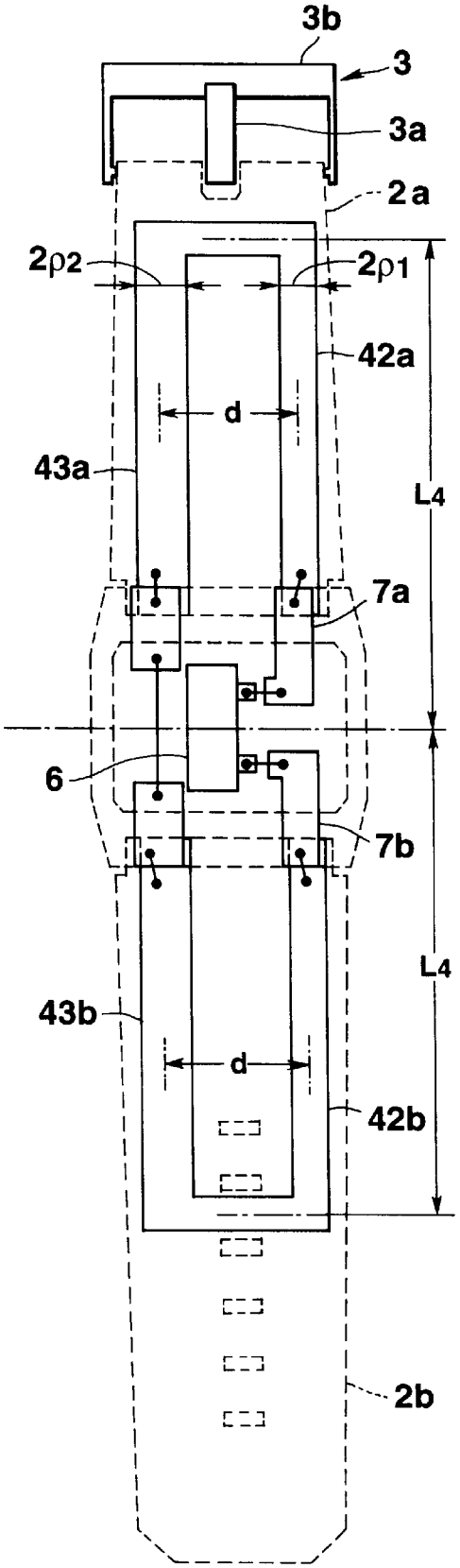

FIG. 11A is a front view of a watch-shaped radio apparatus equipped with an antenna which is the fifth embodiment of the present invention. FIG. 11B is a schematic view of the antenna. Like any embodiment described above, the fifth embodiment has a radio circuit section 6 and power-supply terminals 7*a* and 7*b* as is shown in FIGS. 11A and 11B. An input/output terminal projects from the radio circuit section 6. The input/output terminal is connected to conductive bases 11*a* and 11*b*, both electrically and physically by, for example, solder. The terminal is provided to supply power from the section 6 to antenna conductors 40*a* and 40*b* which are embedded in the band sections 2*a* and 2*b*, respectively, and to supply to the section 6 the power which the antenna conductors 40*a* and 40*b* have received. Further, power-supply terminals 7*a* and 7*b* extend in the axial direction of the band section 2*a* and 2*b* and are connected at one end to the base 11*a* and 11*b*, respectively, both electrically and physically by, for example, solder.

In the band section 2*a*, the other end of the power supply terminal 7*a* is electrically and physically secured to one end of the antenna conductor 40*a* which extends in the axial direction of the band section 2*a*. In the band section 2*b*, the other end of the power supply terminal 7*b* is electrically and physically secured to one end of the antenna conductor 40*b* which extends in the axial direction of the band section 2*b*. The antenna conductors 40*a* and 40*b* are metal strips, thin metal strips or wires, which are flexible. The power-supply terminal 7*a* is provided between the main body 1 and the band section 2*a*, and the power-supply terminal 7*b* between the main body 1 and the band section 2*b*. Both power-supply terminals 7*a* and 7*b* are made of flexible material, allowing the sections 2*a* and 2*b* to move with respect to the main body 1.

The antenna conductor 40*a* consists of two power-supply antenna elements 42*a* and 43*a* which constitute a half-wave antenna having a total length (2L4) equal to half-wave length (λ/2). Similarly, the antenna conductor 40*b* consists of two power-supply antenna elements 42*b* and 43*b* which are parallel to each other, which are connected at one end to each other and which constitute a half-wave antenna having a total length (2L4) equal to half-wave length (λ/2).

2. Electrical Characteristics

As can be seen from FIG. 11B, the diameter 2ρ2 (radius=ρ2) of the antenna conductors, to which no power is supplied, is one to six times as great as the diameter 2ρ1 (radius=ρ1) of the antenna conductors 42*a* and 42*b* which constitute a half-wave antenna and to which power is supplied. The antenna conductors 42*a* and 43*a* are arranged, with their axes spaced apart by a distance d. Also, the antenna conductors 42*b* and 43*b* are arranged, with their axes spaced apart by a distance d.

Figure 12A:
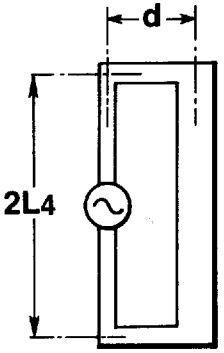
FIGS. 12A and 12B are a schematic view of the antenna shown in FIG. 11B and a schematic view of a folded antenna, respectively.
Figure 12B:
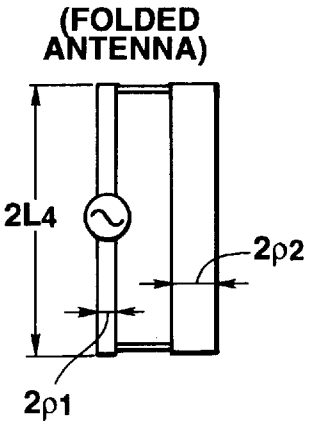

Being large in size, the band antenna according to the fifth embodiment is used as a folded antenna in a high-frequency region. As shown in FIGS. 12A and 12B, a folded antenna is characterized in that the two conductors have radii ρ1 and ρ2 and the distance d between their axes are sufficiently small. When the folded antenna is used in place of a rod-shaped antenna such as a half-wave antenna of ordinary type, its input impedance can easily be changed to an appropriate value, without altering its radiation characteristic. Why so will be explained below.

Figure 13A:
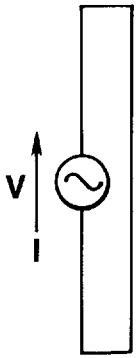
FIGS. 13A through 13E are equivalent circuit diagrams of the antenna according to the fifth embodiment.
Figure 13B:
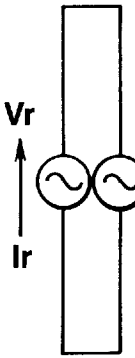

Assume that a voltage V is applied and a current flows, at the power-supplying point of the folded half-wave antenna, as is illustrated in FIG. 13A. The electromagnetic field generated in this case is a combination of two electromagnetic fields shown in FIGS. 13B and 13C. The electromagnetic field of FIG. 13B is one generated when the same voltage Vr is applied at the axes of the two conductors, whereby currents Ir and arIr flow into the two conductors. The electromagnetic field of FIG. 13C is one generated when voltages afVf and −Vf are applied to the two conductors, respectively, whereby currents If and −If flow along the axes of the two conductors in the opposite directions.

Figure 13C:
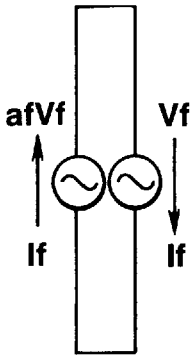

Applying the reciprocity theorem to the two electromagnetic fields shown in FIGS. 13B and 13C, we obtain:

$$(VrIf-afVfIr)+\{Vr(-If)-(-Vf)arIr\}=0 \tag{11}$$

The equation (11) reduces to the following:

$$VrIf-afVfIr-VrIf+arVfIr=0$$

$$arVfIr=afVfIr$$

$$ar=af \tag{12}$$

The electromagnetic field shown in FIG. 13A is the sum of those shown in FIGS. 13B and 13C. Assuming that ar=af=a, we obtain:

$$Vr+aVf=0 \tag{13}$$

$$Vr-Vf=0 \tag{14}$$

$$Ir+If=I \tag{15}$$

Figure 13D:
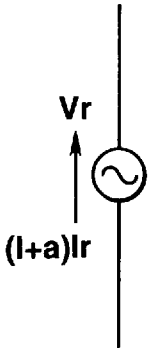

The system shown in FIG. 13B is regarded as one linear antenna composed of a bundle of two conductors. It is therefore equivalent to the antenna shown in FIG. 13D which is constituted by a single thick conductor. The input impedance Zr of the antenna shown in FIG. 13D is given as:

$$Vr=(1+a)IrZr \tag{16}$$

Figure 13E:
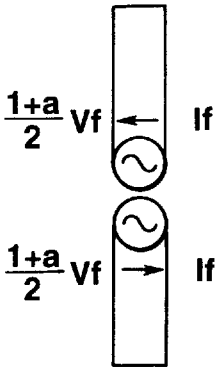

The system shown in FIG. 13C is equivalent to an antenna shown in FIG. 13E which comprises two units, each consisting of two parallel lines which are short-circuited at the distal end and which are supplied with power at the proximal end. The impedance Zf of these units is expressed as:

$$\frac{1}{2}(1+a)Vf=IfZf \tag{17}$$

From the equations (13) and (14) there drives the following equations:

$$Vr=Vf=\frac{V}{(1+a)} \tag{18}$$

$$Ir=\frac{V}{(1+a)^2Zr} \tag{19}$$

$$If=\frac{V}{2Zf} \tag{20}$$

Applying the equations (18), (19) and (20) to the equation (15), we obtain:

$$I=Ir+If=\frac{V}{(1+a)^2Zr}+\frac{V}{2Zf} \tag{21}$$

Therefore, the input impedance of the folded antenna is given as follows:

$$Z=\frac{V}{I}=\frac{2(1+a)^2ZrZf}{(1+a)^2Zr+2Zf} \tag{22}$$

Figure 14:
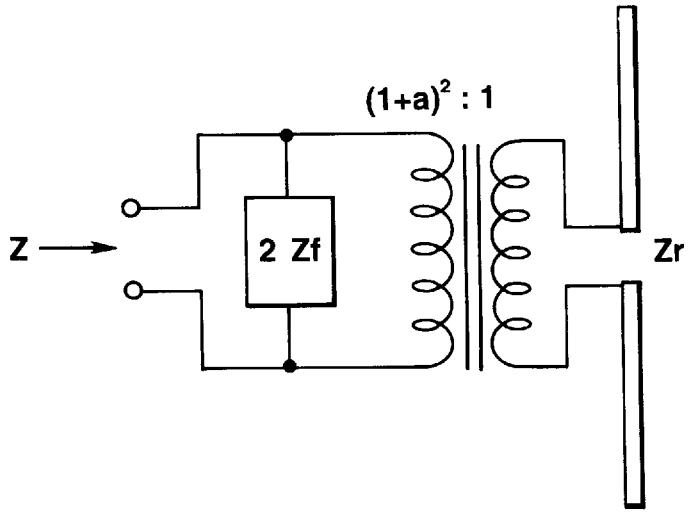
FIG. 14 is an equivalent circuit diagram of the antenna according to the fifth embodiment of the invention.

That is, the input impedance Z is equivalent to a parallel circuit comprised of impedance $Zr(1+a)^2$ and impedance 2Zf, which is represented by the circuit diagram of FIG. 14. The current radiated is 2Ir only, as is clear from FIGS. 13A to 13E, and the folded antenna is equivalent to the antenna illustrated in FIG. 13D, which is shown in FIG. 13D. Therefore, the folded antenna has the same directivity as one linear antenna, provided it involves no power loss. The electromagnetic field shown in FIG. 13E is considered to do nothing but change the electromagnetic field generated near the antenna, ultimately changing the input impedance or received voltage, as can be understood from FIG. 14.

The input impedance Zf of the folded antenna is obtained as follows:

$$Zr=jZ0\tan kL \tag{23}$$

where Z0 is the impedance inherent in the two parallel lines and 2L is the overall length of the antenna. /Zf/=∞ if the antenna is a half-wave antenna wherein 2L=λ/2. Hence, the equation (22) reduced to the following:

$$Z=(1+a)^2Zr \tag{24}$$

Obviously, the input impedance Z is $(1+a)^2$ times the impedance Zr of the half-wave antenna. Variable a is given as:

$$a = \frac{\cosh^{-1}\left(\frac{\nu^2 - \mu^2 - 1}{2\nu}\right)}{\cosh^{-1}\left(\frac{\nu^2 + \mu^2 - 1}{2\mu\nu}\right)} \cong \frac{\ln\nu}{\ln\nu - \ln\mu} \quad (25)$$

where, $\rho^2 = \mu\rho 1$, $d = \nu\rho 1$

If $\rho 1 = \rho 2$, $\mu = 1$. In this case, a=1, regardless of the value of ν. Thus, $(1+a)^2=4$. Namely, the input impedance Z is as four times as high as that of the half-wave antenna. The input impedance Z can be changed merely by adjusting variable $\mu(=\rho 2/\rho 1)$ and variable $\nu(=d/1)$, both included in the equation (25). Differently stated, Z can be changed by adjusting the diameter ρ1 of the antenna conductors 42*a* and 42*b*, the diameter ρ2 of the antenna conductors 43*a* and 43*b* and the above-defined distance d.

Generally, impedance conversion ratio a (i.e., $(1+a)^2$) is limited by the diameter of the antenna conductors. The ratio can easily be set at a value ranging from 2 to 10, thanks to the resistance loss and mechanical strength of the antenna. The folded antenna is a broad-band one and is advantageous, in this respect, over a single-conductor which has the same conductor diameter. This is because Zr and Zf involve serial resonance and parallel resonance, respectively, and are connected in parallel to each other.

Sixth Embodiment

Figure 15:
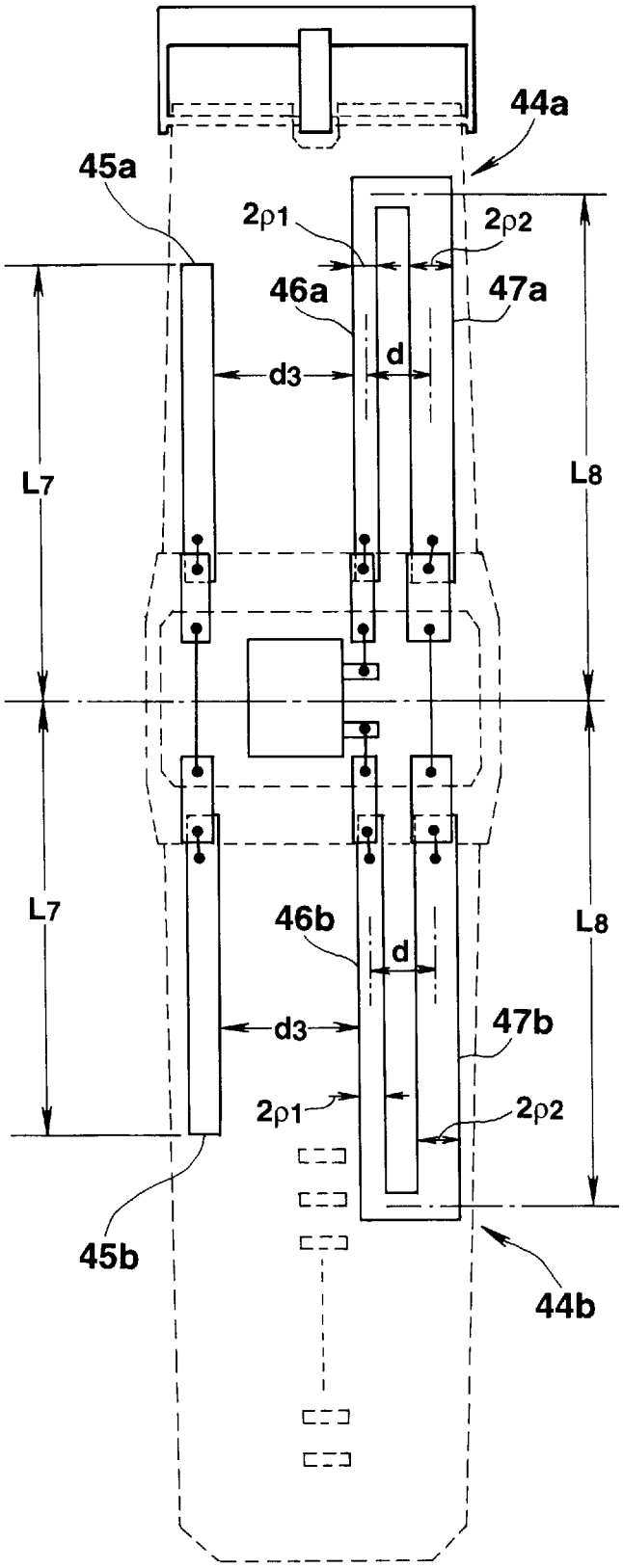
FIG. 15 is a schematic representation of an antenna according to a sixth embodiment of the present invention.
Figure 16A:
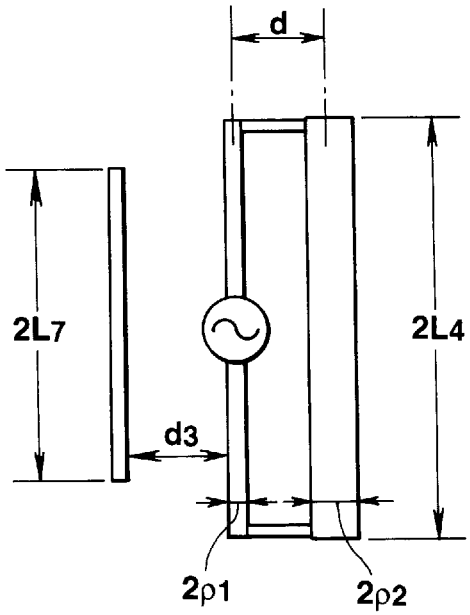
FIGS. 16A and 16B are a schematic diagram of equivalent circuit diagram of the antenna shown in FIG. 15, respectively.
Figure 16B:
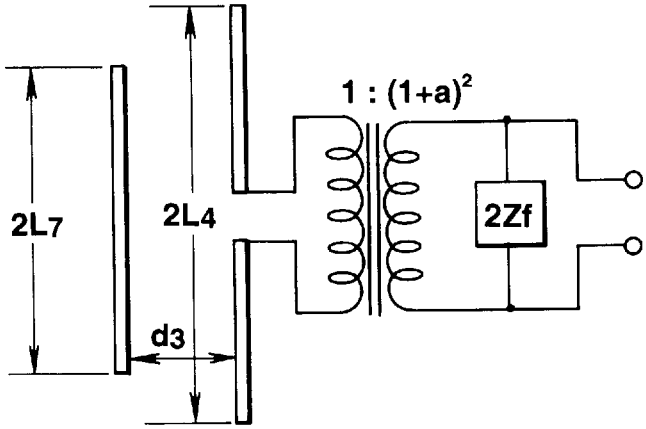

FIG. 15 is a schematic representation of a band antenna according to the sixth embodiment of this invention. FIG. 16A is another schematic diagram of the band antenna, and FIG. 16B is an equivalent circuit diagram thereof.

As illustrated in FIG. 15, a loop-shaped antenna conductor 44*a* and a straight antenna conductor 45*a* are embedded in a band section 2*a*, extend parallel to each other and are spaced apart from each other by a distance d3. Similarly, a loop-shaped antenna conductor 44*b* and a straight antenna conductor 45*b* are embedded in a band section 2*b*, extend parallel to each other and are spaced apart from each other by a distance d3. In operation, power is supplied to the antenna conductors 44*a* and 44*b*, and no power is supplied to the antenna conductors 45*a* and 45*b*. The antenna conductors 44*a*, 44*b*, 45*a* and 45*b* are metal strips, thin metal strips or wires, which are flexible. The distance d3 is 0.2 to 1.5 times the quarter-wave length (λ/4).

The U-shaped antenna conductor 44*a* consists of two parallel conductors 46*a* and 47*a* which are connected together at their distal end and which are arranged with their axes spaced apart by a distance d. The loop-shaped antenna conductor 44*b* consists of two parallel conductors 46*b* and 47*b* which are connected together at their distal end and which are arranged with their axes spaced apart by the distance d. The conductors 46*a* and 46*b* constitute a half-wave (λ/2) antenna having an overall length 2L8. The conductors 47*a* and 47*b*, to which no power is applied, constitute a half-wave (λ/2) antenna having the same overall length 2L8. The antenna conductors 44*a* an 44*b* constitute a folded half-wave antenna having an overall length 2L4 (see FIG. 16A).

The antenna conductors 45*a* and 45*b* are short-circuited, constituting a director which has an overall length 2L7. The length 2L7 is less than the overall length 2L4 (λ/2) of the folded half-wave antenna. More precisely, the length 2L7 is 0.8 to 0.9 times the overall length 2L4 of the folded half-wave antenna. The antenna conductors 45*a* and 45*b* therefore operate as directors. The thicker the conductors 45*a* and 45*b*, the shorter they can be to work as directors.

Thus, as shown in FIG. 16A, the sixth embodiment is a band antenna which comprises a folded antenna and a director. The structure of the band antenna according to the sixth embodiment can be represented by the equivalent circuit diagram of FIG. 16B.

If the antenna conductors 45*a* and 45*b* are longer or shorter than the antenna conductors 44*a* and 44*b*, more precisely if the overall length 2L7 of the director is greater or less than the overall length 2L4 of the folded half-wave antenna constituted by the conductors 44*a* and 44*b*, the reactance component of the self-impedance of each of the conductors 44*a* and 44*b*, the total length of which nearly equals the half-wave length λ/2, changes greatly, while the resistance component of the self-impedance changes a little. The mutual impedance Z21 between the half-wave antenna and the director changes but a little if the overall length 2L7 of the director (i.e., the conductors 45*a* and 45*b*). Hence, the change in the length 2L7 of the conductors 22*a* and 22*b* causes a change in the reactance X22 only.

The sixth embodiment can have its input impedance increased over that of a half-wave antenna having elements to which no power is supplied—without reducing the large gain or the good directivity. Furthermore, the axial gain (ϕ=0) or anti-axial gain (ϕ=180°) can be more increased than is possible with the folded antenna of the fifth embodiment, since the length of the antenna conductors 45*a* and 45*b* are adjusted with respect to the length of the antenna conductors 44*a* and 44*b*. In addition, the conductors 45*a* and 45*b* can function as a director or a reflector, thereby to change the gain or directivity of the band antenna, by adjusting their length with respect to the length of the antenna conductors 44*a* and 44*b*.

Seventh Embodiment

1. Radio Apparatus

FIG. 17A is a front view and FIG. 17B is a sectional view of a watch-shaped radio apparatus equipped with a patch antenna which is the seventh embodiment of the present invention. As shown in FIGS. 17A and 17B, the watch-shaped radio apparatus comprises a main body 1 and two band sections 2*a* and 2*b*. The main body 1 contains electronic components which perform watch function and radio-apparatus function. The band sections 2*a* and 2*b* are connected to the main body 1 to secure the main body 1 to a user's wrist. The main body 1 has a display 1*f* which is an LCD or the like, on its upper surface. The display 1*f* is protected by a glass cover 1E. On its each side the main body 1 has switches 1*d* for switching the operating mode of the apparatus and the display mode of the display 1*f*.

Contained in the main body 1 are a radio circuit section 6*a* and a battery 6*b*. The battery 6*b* is provided to supply power to the radio circuit section 6*a*. The section 6*a* comprises an electronic circuit which is designed to supply power to a patch antenna 9 and to receive power therefrom. (The patch antenna 9 will be described later.) The section 6*a* is connected to the patch antenna 9 by a coaxial cable 8. The patch antenna 9 is located in the antenna receptacle 10*c* which is mounted on one side of the main body 1.

2. Structure of Patch Antenna

FIG. 18A is a front view and FIG. 18B is a sectional view of the patch antenna 9. As shown in FIGS. 18A and 18B, the patch antenna 9 is a three-layer component, comprising a base plate 11*c*, a dielectric layer 12*c*, and a patch-shaped conductor 13*c*. The base plate 11*c* is made of electrically conductive material. The dielectric layer 12*c* is made of the same material as the band sections 2*a* and 2*b* (FIG. 17A), such as Teflon. The conductor 13*c* has an effective length which is less than or equal to $\lambda/(4\sqrt{\epsilon})$, or less than or equal to $\lambda/4$, where $\lambda$ is wavelength. The base plate 11*c* and the conductor 13*c* are connected to the coaxial cable 8, at a power-supplying point 14*c*. That end portion of the conductor 13*c* which is close to the main body 1 is bent in the form of letter L and is short-circuited to the base plate 11*c*. In short, the patch-antenna 9 comprises two conductors and one insulating layer sandwiched between the conductors. The operating principle of the patch antenna 9 will be explained below.

3. Operating Principle of the Patch Antenna

Figure 19:
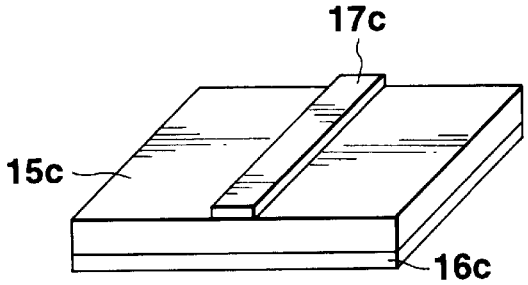
FIG. 19 is a perspective view of a micro-strip line, explaining the operating principle of the patch antenna.

A micro-strip antenna, usually formed on a printed circuit board, is used in increasing numbers as a small-sized antenna or a component of an array antenna. This is because it is easy to manufacture and has a planar structure. As shown in FIG. 19, a micro-strip antenna comprises a dielectric layer 15*c*, a base plate 16*c*, and a micro-strip line 17*c*. The base plate 16*c* is a conductive layer bonded to one surface of the layer 15*c* and thinner than the layer 15*c*. The micro-strip line 17*c* has been formed by processing a conductive layer bonded to the other surface of the layer 15*c*. The line 17*c* is a signal transfer line which is thinner than a coaxial cable.

Figure 20A:
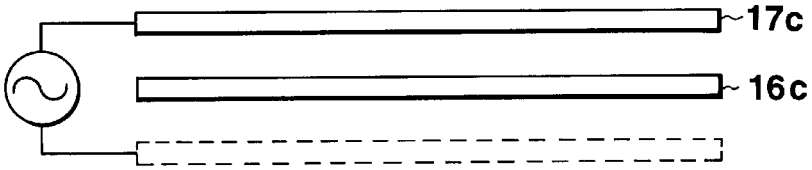
FIGS. 20A, 20B and 20C are an equivalent circuit diagram of a micro-strip antenna, a graph showing the current- and voltage-distribution in the micro-strip antenna and a sectional view of the micro-strip antenna, respectively.
Figure 20B:
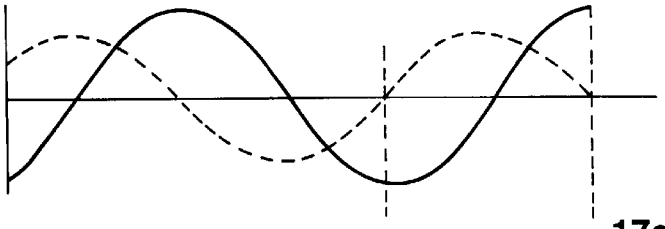
Figure 20C:
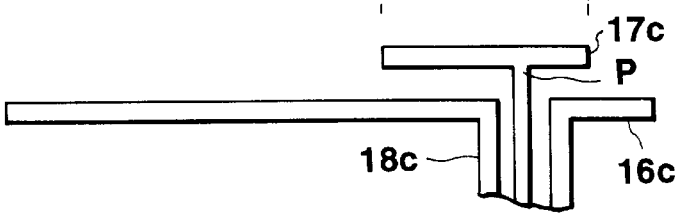

Once the base plate 16*c* and the micro-strip line 17*c* are connected to a power supply, the line 17*c* becomes equivalent to two parallel signal transfer lines provided beneath the base plate 16*c* as indicated by dotted lines in FIG. 20A. When these signal transfer lines are opened at their terminations, stationary waves are generated as illustrated in FIG. 20B. As seen from FIG. 20B, the electric field is most intense at the termination of the either signal transfer line as depicted by the solid-line curve, while the current is zero at the termination of either signal transfer line as indicated by the broken-line curve. As shown in FIG. 20C, the micro-strip line 17*c* is cut at a half-wave distance from its end, and power is supplied to the line 17*c* at point P located at some distance from the center of the line 17*c*, from below the base plate 16*c* through a coaxial cable 18*c*. The micro-strip antenna is thereby manufactured.

When these signal transfer lines are opened at the termination, the reflection factor becomes "1," whereby all power supplied is reflected and the electric field gains the maximal intensity at the termination of either signal transfer line. On the other hand, the current becomes zero and the magnetic field ceases to exist. When these signal transfer lines are short-circuited at the termination, the electric field ceases to exist and the magnetic field gains its maximum intensity. In this case, a conductive wall is present at the termination of either signal transfer line. The electric field and the magnetic field change in opposite directions when the signal transfer lines are opened at the termination. Since the change in the electric field and the change in the magnetic field are similar phenomena, the end of either signal transfer line can be considered to have been closed by a magnetic wall. The relation between an electric field and a conductive wall is the same as the relation between a magnetic field and a magnetic wall. Hence, no magnetic field is generated which extends parallel to the magnetic wall. In other words, any magnetic field generated extends perpendicular to the magnetic wall.

Figure 21A:
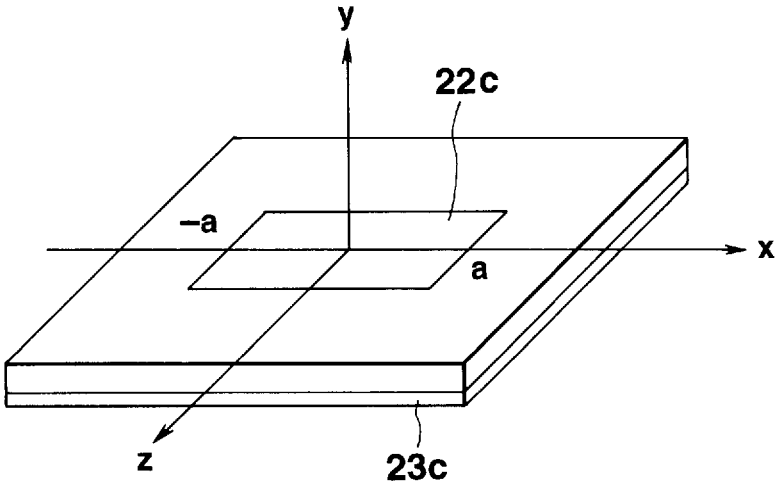
FIGS. 21A and 21B are, respectively, a perspective view of a micro-strip line made in the form of a rectangular patch and a diagram illustrating how power is radiated from the micro-strip line.

Since the micro-strip line 17*c* is cut and exposed, it can be said to be surrounded by magnetic walls and short-circuited thereby. The micro-strip line 17*c*, thus cut, is also called "patch." If the patch is surrounded and short-circuited by magnetic walls, no radio waves are radiated from the patch. The patch therefore does not function as an antenna at all. Nonetheless, the patch is used as so-called "magnetic wall model" for calculating a simple approximate value for the electromagnetic field or resonance frequency in the patch. FIG. 21A shows a rectangular patch 22*c* mounted on a base plate 23*c*. The electric field generated between the patch 22*c* and the base plate 23*c* has a y-axis component only. The y-axis component generated when the patch 22*c* undergoes resonance is given as:

$$Ey = E_{sin}\frac{\pi x}{2a} \tag{26}$$

where 2*a* is the half-wave length of the micro-strip line. The half-wave length 2*a* is expressed as follows:

$$2a = \frac{\lambda}{2\sqrt{\epsilon}} \tag{27}$$

where $\lambda$ is the free-space wavelength.

where $\lambda$ is the dielectric constant of the base plate 23*c*. The base plate 23*c* is made of Teflon as in most patch antennas. Teflon has a specific dielectric constant $\epsilon$ of 2.4. Therefore, the wave has a length which is 0.6 times the free-space wavelength $\lambda$.

Figure 21B:
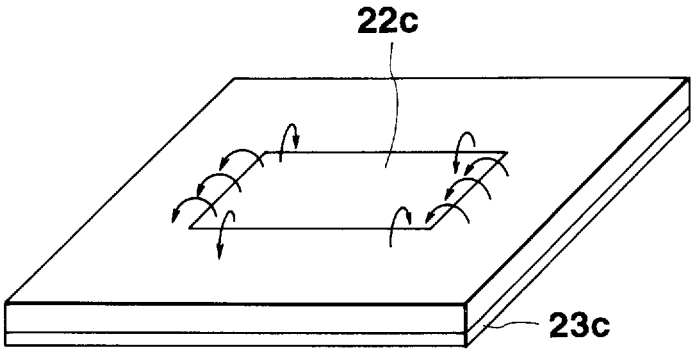
Figure 22A:
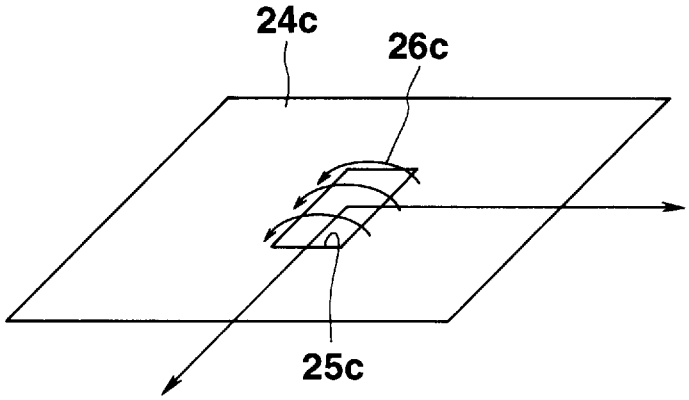
FIGS. 22A and 22B show an electric field generated at a conductor plate having a slot in the center part and an electric field generated from a small dipole current.
Figure 22B:
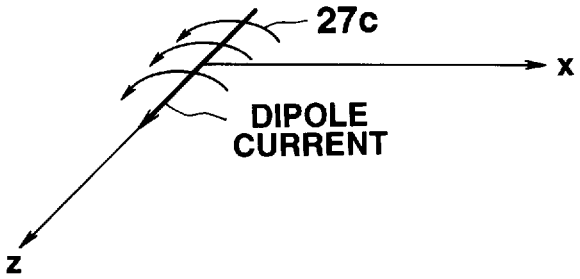

When the termination of the signal transfer line is opened, all power is reflected, except a part. The part of power leaks outwards as shown in FIG. 21B, in the same way as an electric field leaks through a slot cut in a conductive plate. As shown in FIG. 22A, an electric field 26*c* leaks upward through a slot 25*c* made in a conductive plate 24*c*. If a current generated by a tiny dipole flows at the slot 25*c*, a magnetic field 27*c* will be generated as shown in FIG. 22B, in which only upper half of the magnetic field 27*c* is illustrated. The electric field 26*c* leaking through the slot 25*c* and the magnetic field 27*c* generated from the dipole current are identical in shape, both extending in the $\phi$-axis direction in the polar coordinate system. From this it can be said that a magnetic current flowing through the slot 25*c* constitutes a magnetic (electric) field. Hence, the electromagnetic field radiating from the slot 25*c* can be obtained by replacing the electric field and the magnetic field with each other, which constitute an electromagnetic field and which have been generated from a current.

Figure 23A:
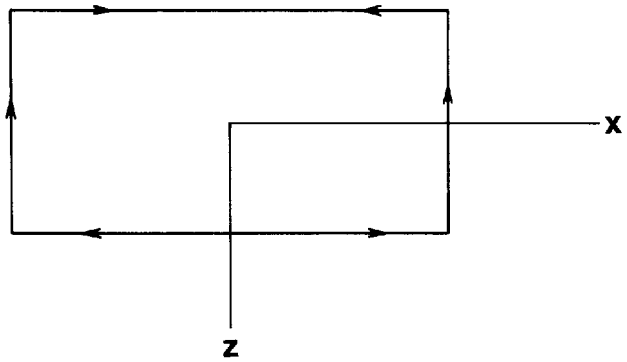
FIGS. 23A and 23B are, respectively, a diagram showing a magnetic current flowing in a patch antenna and a diagram illustrating a rectangular loop antenna in which a current flows in the same way as the magnetic current.
Figure 23B:
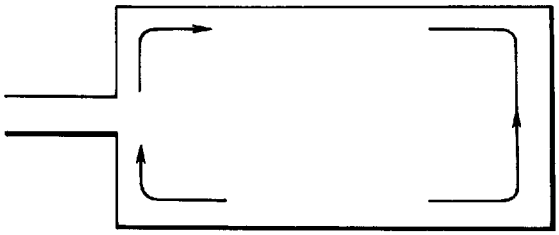

The directivity of the micro-strip antenna is obtained from a magnetic current. The magnetic current constitutes an electric field, which corresponds to a magnetic field constituted by currents which flow in the same way as the magnetic current. Since an electric field is generated at the edges of the patch 22*c* as shown in FIG. 21B, a magnetic current flows as shown in FIG. 23A, forming a source of radio waves. An antenna, whose wave source is a current flowing in the same way as this magnetic current, is a rectangular loop antenna which is shown in FIG. 23B. The loop antenna radiates intense radio waves in the y-axis direction. Of the magnetic current shown in FIG. 23A, two parts extending in the x-axis direction are short and opposite to each other. The remaining two parts extend in the z-axis direction and mainly serve as source of radio waves. The loop antenna therefore has almost the same directivity as an array antenna which comprises two dipole antenna juxtaposed in the z-axis direction. The electric field extending in the z-axis direction is zero in intensity as can be understood from the equation (26) and the electric field generated at the patch 22*c* (FIG. 21B). Thus, the distribution of the electromagnetic field remains unchanged if the patch 22*c* is short-circuited at its center part.

Figure 24A:
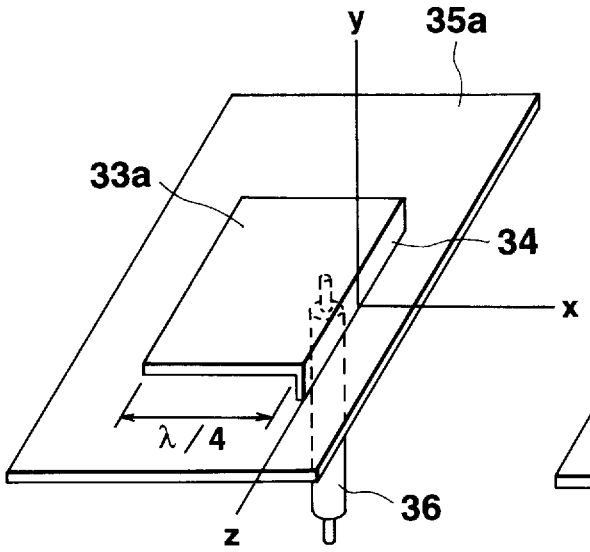
FIGS. 24A, 24B 24C and 24D are a perspective view of a patch antenna, a perspective view of a small patch antenna, a diagram showing an inverted-L antenna and a diagram showing an inverted-F antenna, respectively.

Hence, even if the patch 22*c* is cut into halves, or two patches 33*a*, each patch 33*a* functions as an antenna as illustrated in FIG. 24A. The patch 33*a* is obviously useful as a small-sized antenna. As shown in FIG. 24A, the patch 33*a* is grounded at one side to a base plate 35*a* by a short-circuiting plate 34. A coaxial cable 36 is connected to the center portion of the patch 33*a*, to supply power thereto. The patch antenna shown in FIG. 24A is of the same structure as the antenna shown in FIGS. 17 and 18. The length of the patch antenna, measured in the x-axis direction, is $\lambda/4$. If designed to transmit and receive radio waves of the 900 MHz band, such as mobile-telephone waves, the patch antenna is about 8.3 cm long, provided that the base plate 35*a* has a specific dielectric constant of 1. The patch antenna cannot be said to be small enough for use in mobile telephones.

The width of the patch antenna, measured along the z-axis (i.e., transverse axis), depends on the frequency band of radio waves the antenna is to transmit and receive. Namely, the broader the band, the broader the antenna. In the case where the frequency band allocated to mobile telephones ranges from 900 MHz to about 910 MHz, the patch 33*a* should be almost square. This is because, the patch 33*a* will radiate radio waves readily over a broad band if the patch 33*a* has a large width. The width of the patch 33*a* is equal to the length of the magnetic-current dipole. The longer the dipole, the higher the radiation resistance, and the higher the efficiency of radiation of radio waves.

Figure 24B:
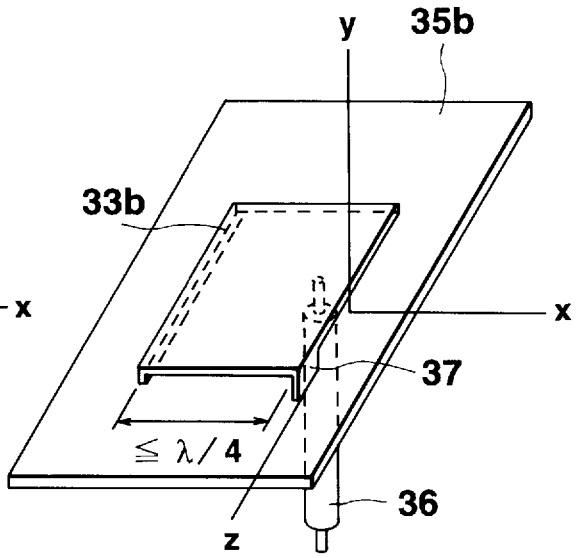
Figure 24C:
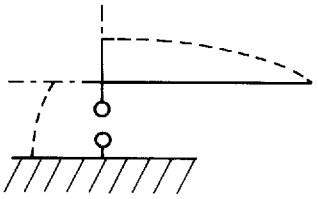

FIG. 24C is a diagram showing a small-sized patch antenna. This patch antenna is identical to the patch antenna shown in FIG. 24A, except for two respects. First, a narrow strip 37 is used in place of the short-circuiting plate 34. Second, the patch 33*b* equivalent to the patch 33*a* (FIG. 24A) is bent downwards at one edge. The narrow strip 37 works as an inductance mounted on the patch 33*b*. The bent edge of the patch 33*b* imparts to the antenna a capacitance large enough to generate an intense electric field at that edge of the patch 33*b*. Generally, an antenna becomes smaller when an impedance is mounted on it. Hence, the length of the patch 33*b* can be decreased to $\leqq\lambda/4$.

Figure 24D:
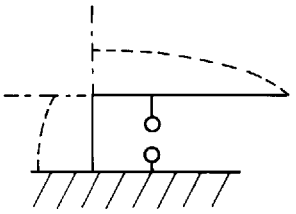

Hitherto known is an inverted-L antenna which is illustrated in FIG. 24C. The patch of this antenna has half-wave length. The patch is bend in the form of letter L, because it is difficult in practice to stretch it straight. The quarter-wave length ($\lambda/4$) will be as much as 75 m if the antenna is designed to transmit and receive 1 MHz waves which are 300 m long. Also known is another type of an antenna called "inverted-F antenna," which is shown in FIG. 24D. The inverted-F antenna differs from the inverted-L antenna in that power is supplied to the middle part of the patch, improving the operating efficiency of the antenna.

In the case of a rod-shaped antenna, the thicker conductor, the broader the frequency band of the antenna. The rod-shaped conductor may be replaced by a plate-shaped conductor which has a large width. An antenna having such a plate-shaped conductor is the very patch antenna which is illustrated in FIG. 24B.

Three patch antennas having different shapes will be described, with reference to FIGS. 25, 26 and 27.

Figure 25A:
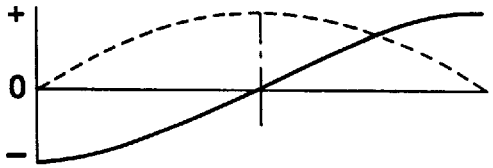
FIG. 25B is a front view of a patch antenna.
FIG. 25C is a sectional view of the patch antenna and a FIG. 25A is a diagram showing the current-voltage characteristic thereof, respectively.
Figure 25B:
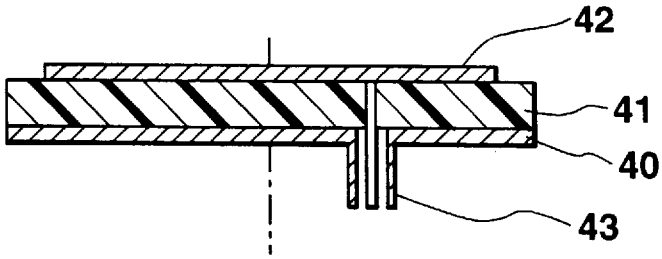
Figure 25C:
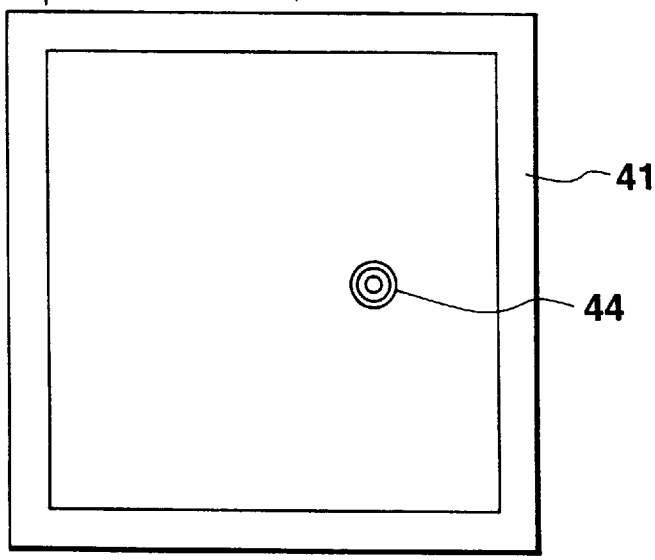

FIG. 25B is a front view of a patch antenna, FIG. 25C is a sectional view of the patch antenna, and FIG. 25A is a diagram showing the current-voltage characteristic thereof. The patch antenna is a half-wave antenna. As shown in FIG. 25B, it is a three-layer structure, comprising a base plate 40, a dielectric layer 41 and a patch-shaped conductor 42. The base plate 40 is made of electrically conductive material. The dielectric layer 41, which is interposed between the base plate 40 and the conductor 42, is made of dielectric material such as Teflon. The patch-shaped conductor 42 has an effective length 2*a* ($=\lambda/(2\sqrt{\epsilon})$). The antenna further comprises a coaxial cable 43, which is connected to the base plate 40 and conductor 42, extending from a power-supply point 44.

Figure 26A:
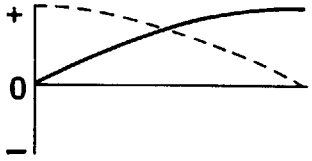
FIG. 26C is a sectional view of the patch antenna and FIG. 26A is a diagram showing the current-voltage characteristic thereof, respectively.
Figure 26B:
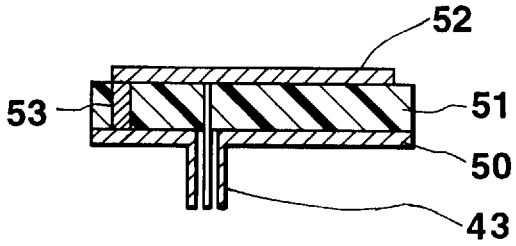
FIG. 26B is a front view of another patch antenna.
Figure 26C:
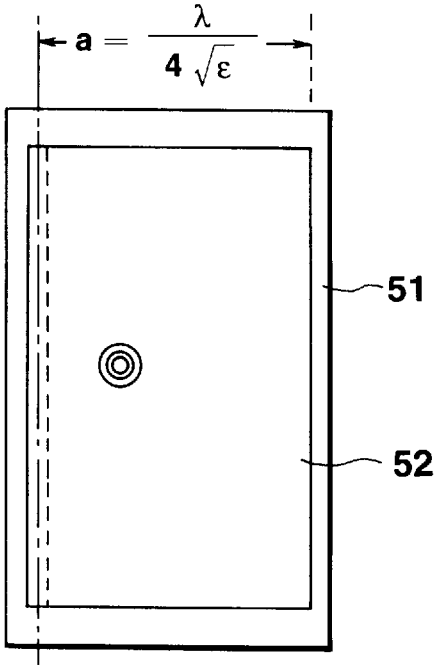

FIG. 26B is a front view of another patch antenna, FIG. 26C is a sectional view of the patch antenna, and FIG. 26A is a diagram showing the current-voltage characteristic thereof. This is a $\lambda/4$ inverted-L patch antenna of the type shown in FIG. 24A. It is also a three-layer structure, comprising a base plate 50, a dielectric layer 51 and a patch-shaped conductor 52. The base plate 50 is made of electrically conductive material. The dielectric layer 51, which is interposed between the base plate 50 and the conductor 52, is made of dielectric material such as Teflon. The patch-shaped conductor 52 has an effective length a ($=\lambda/(4\sqrt{\epsilon})$). The inverted-L patch antenna further comprises a short-circuiting plate 53, which electrically connects one edge of the conductor 52 to the base plate 50.

Figure 27A:
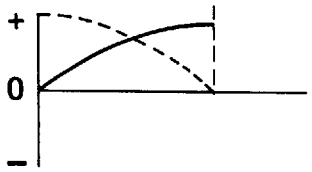
FIG. 27C is a sectional view of this patch antenna and FIG. 27A is a diagram showing the current-voltage characteristic thereof, respectively.
Figure 27B:
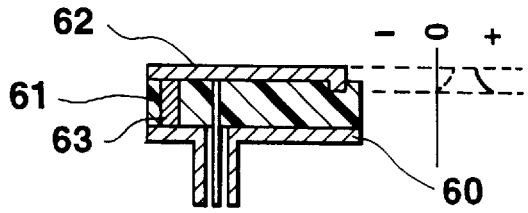
FIG. 27B is a front view of still another patch antenna.
Figure 27C:
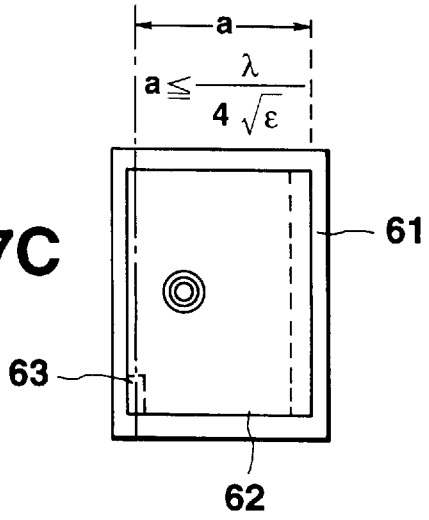

FIG. 27B is a front view of still another patch antenna, FIG. 27C is a sectional view of this patch antenna, and FIG. 27A is a diagram showing the current-voltage characteristic thereof. This is a $\lambda/4$ inverted-F patch antenna of the type shown in FIG. 24B. It is also a three-layer structure, comprising a base plate 60, a dielectric layer 61 and a patch-shaped conductor 62. The base plate 60 is made of electrically conductive material. The dielectric layer 61, which is interposed between the base plate 60 and the conductor 62, is made of dielectric material such as Teflon. The patch-shaped conductor 62 has an effective length a ($\leqq\lambda/(4\sqrt{\epsilon})$). The inverted-L patch antenna further comprises a short-circuiting plate 63, which electrically connects one edge of the conductor 62 to the base plate 60. The patch-shaped conductor 62 is bent at one edge in the form of letter L.

Eighth Embodiment

Needless to say, the present invention can be applied to any one of the three patch antennas shown in FIGS. 25B, 26B and 27B. The patch antenna shown in FIG. 26B will be described as the eighth embodiment of the present invention, with reference to FIGS. 28, 29, 30A, 30B and 30C.

Figure 28:
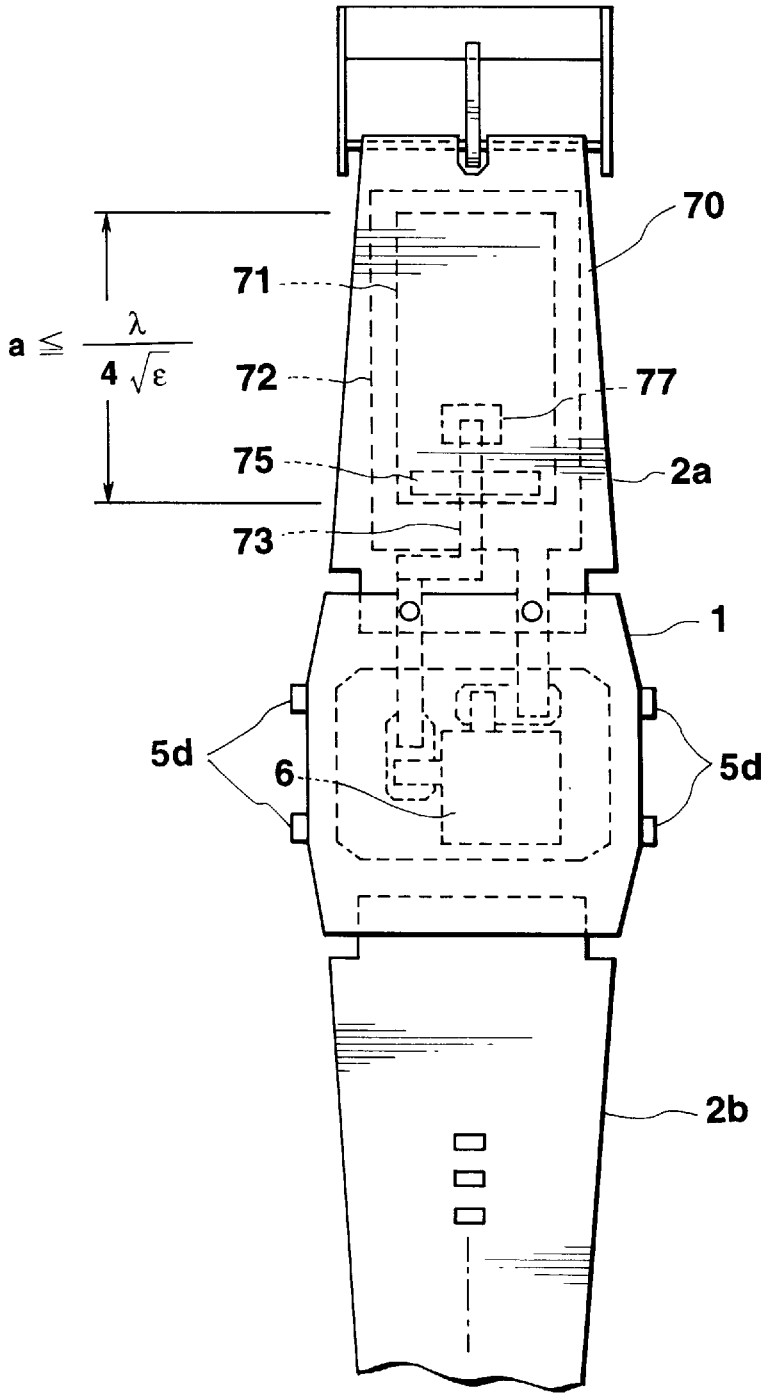
FIG. 28 is a schematic representation of an antenna according to an eighth embodiment of the present invention.
Figure 29:
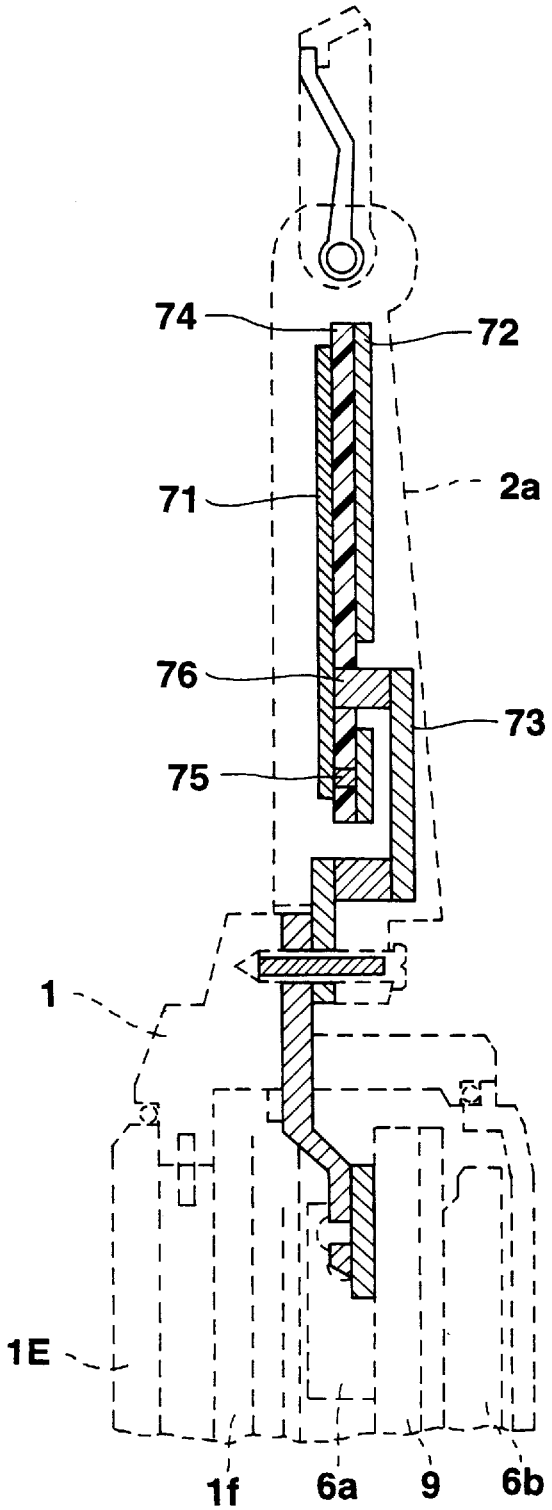
FIG. 29 is a sectional view of a part of the antenna shown in FIG. 28.
Figure 30A:
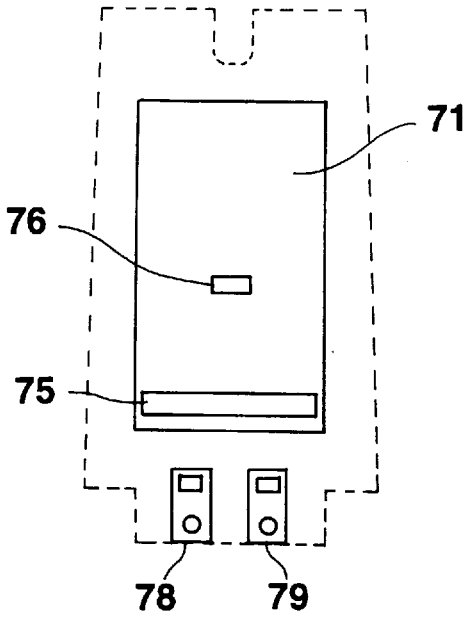
FIGS. 30A through 30C are front views of the antenna of FIG. 28, illustrating the layers which constitute the antenna.
Figure 30B:
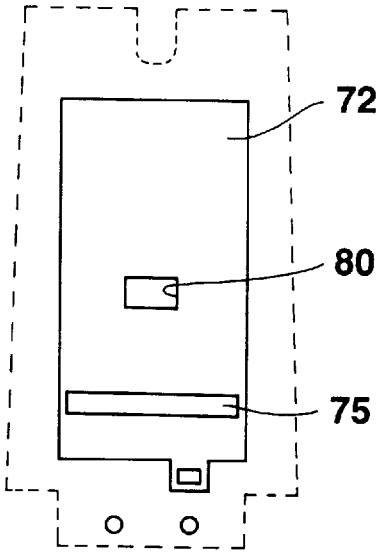
Figure 30C:
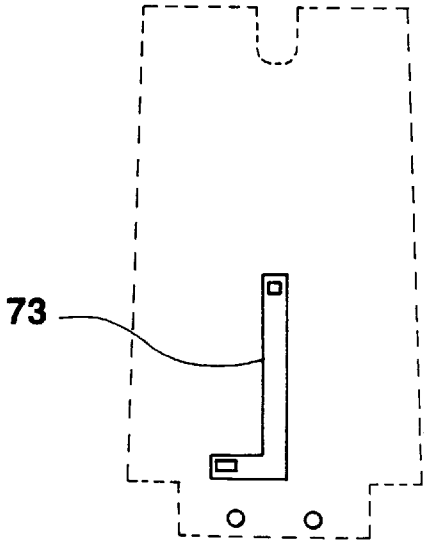

FIG. 28 is a schematic representation of the patch antenna, FIG. 29 is a sectional view of a part of the patch antenna, and FIGS. 30A to 30C are front views of the patch antenna, illustrating the layers which constitute the antenna. The components identical or similar to those shown in FIG. 17 are designated at the same reference numerals in FIGS. 28, 27, 30A, 30B and 30C and will not be described in detail in the following explanation.

As shown in FIGS. 28 and 29, the patch antenna 50 of three-layer structure is embedded in a band section 2*a* or formed integral therewith. The antenna 50 comprises a patch-shaped conductor 71 and a base plate 72. A conductor strip 73 connects the conductor 71 and the plate 72 are connected to a radio circuit section 6 which is incorporated in a main body 1. The patch-shaped conductor 71 extends parallel to the axis of the band section 2*a* and has an overall length a ($\leqq\lambda/4\sqrt{\epsilon}$). The conductor 71 is connected to the base plate 72 by a conductor 75 which passes through a dielectric layer 74. The conductor 71 is connected also to the conductor strip 73 by a conductor 76 which passes through the dielectric layer 74. Power is supplied at a point 77 where the patch-shaped conductor 71 is connected to the conductor strip 73.

The patch antenna 70 is a three-layer structure as shown in FIG. 30A. The first layer comprises the patch-shaped conductor 71 and connecting terminals 78 and 79. The terminals 78 and 79 connect the conductor 71 to the radio circuit section 6. The second layer is the base plate 72 which has a through hole 80 at a power-supply point 77. The third layer is the conductor strip 73 which extends from the point 77 to the connecting terminal 78 as is illustrated in FIG. 30C.

The band section 2*a* can be made longer than the main body 1 as in most watch-shaped radio apparatuses. The patch-antenna 70 can be as long as about 6 to 8 cm. Since the conductor 71 and the plate 72 (i.e., the two conductors of antenna 70) are electrically connected together at their outer ends by means of the conductor 75, the antenna 70 can be used as a quarter-wave ($\lambda/4$) antenna which has half the length of a rod-shaped half-wave antenna. Further, the antenna 70 can function as a so-called inverted-F quarter-wave antenna, since the power-supply point 77 is displaced a little toward the main body 1 from the center of the patch-shaped conductor 71.

The dielectric layer 74, which is made of Teflon or the like, is sandwiched between the patch-shaped conductor 71 and the base plate 72. The dielectric layer 74 therefore works as a signal transfer line of micro-strip type. This helps to reduce the length of the antenna 70, which operates as a patch-shaped, micro-strip antenna, to $\lambda/4\sqrt{\epsilon}$ or less. That is, the antenna 70 can be made small. The patch-shaped conductor 71, base plate 72 and conductor strip 73 can be formed on the band section 2*a*, easily by punching, print etching or the like. The patch antenna 70 can be thin enough to be incorporated into the band section 2*a* since its constituent layers are thin metal layers.

Ninth Embodiment

Figure 31A:
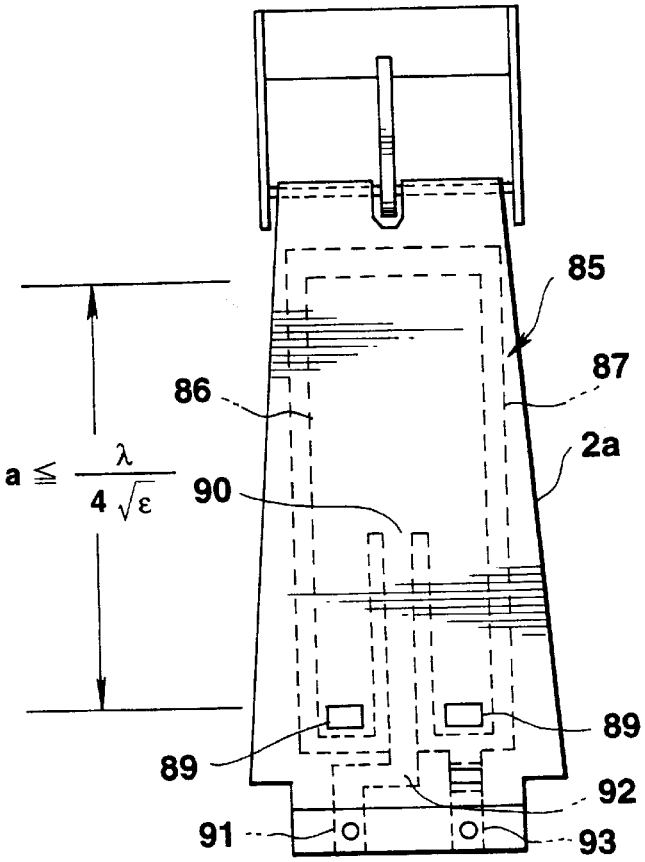
FIGS. 31A and 31B are a front view and partially sectional view of an antenna according to a ninth embodiment of the invention.
Figure 31B:
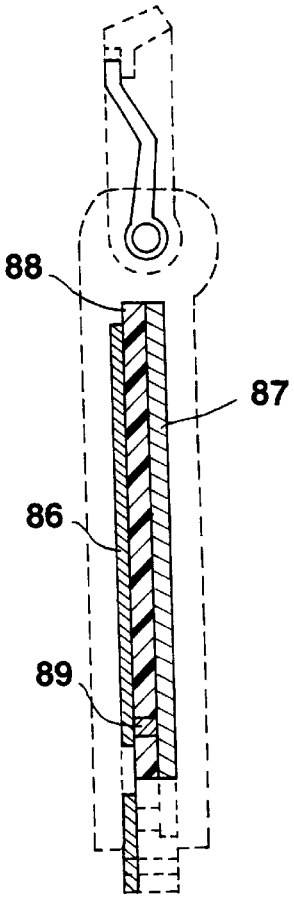
Figure 31C:
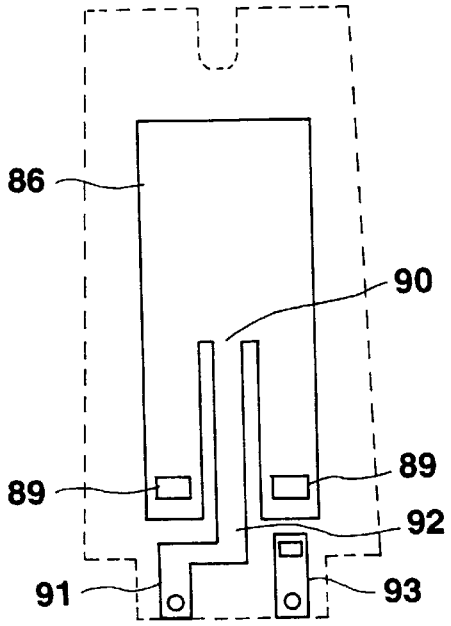
FIGS. 31C and 31D are front views of the antenna shown in FIGS. 31A and 31B, illustrating the layers which constitute the antenna.
Figure 31D:
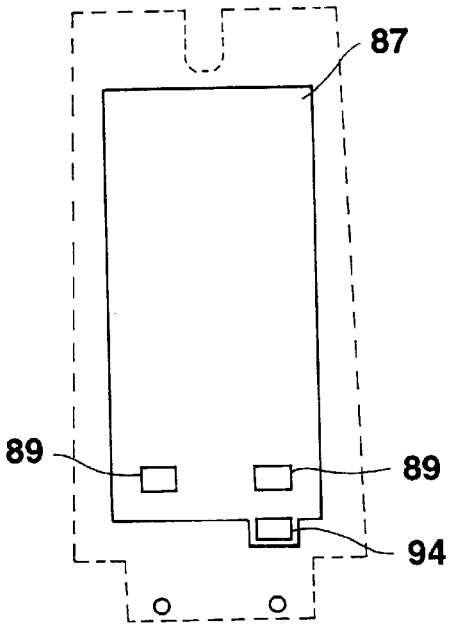

FIGS. 31A and 31B are a front view and partially sectional view of an antenna according to the ninth embodiment of the invention. FIGS. 31C and 31D are front views of this antenna, illustrating the layers which constitute the antenna. The components identical or similar to those shown in FIGS. 28 and 29 are designated at the same reference numerals in FIGS. 31A to 31D and will not be described in detail.

The ninth embodiment is a patch antenna 85, which is embedded in a band section 2*b*. The patch antenna 85 is a three-layer structure like the eighth embodiment or formed integral therewith. The antenna 85 comprises a patch-shaped conductor 86, a base plate 87 and a dielectric layer 88. The dielectric layer 88 is made of Teflon or the like and sandwiched between the conductor 86 and the base plate 87. (Alternatively, the layer 88 may be made of the same material as the band section 2*a*.) The patch-shaped conductor 86 and the base plate 87 are connected to each other by two terminals 89 which pass through the dielectric layer 88. The conductor 86 extends parallel to the axis of the band section 2*a* and has an overall length a ($\leqq\lambda/4\sqrt{\epsilon}$). Power is supplied to the patch-shaped conductor 86 at a point 90 which is displaced a little from the center of the conductor 86 toward the main body (not shown) of a watch-shaped radio apparatus incorporating the patch antenna 85. The antenna 85 further comprises a conductor strip 92 which extends from the point 90 toward the main body, forming a connecting terminal 91.

As shown in FIG. 31C, the patch-shaped conductor 86, the conductor strip 92, and a connecting terminal 93 are provided in the same plane. The connecting terminal 93 connects the base plate 87 to the radio circuit section (not shown) provided in the main body. As shown in FIG. 31B, the base plate 87 is located below the conductor 86. As shown in FIG. 31D, the base plate 87 has a projection 94, which is connected to the connecting terminal 93. The patch antenna 85 has only two conductive layers (i.e., patch-shaped conductor 86 and base plate 87) and only one insulating layer (i.e., dielectric layer 88) interposed between the conductor layers. The patch antenna 85 is no doubt more simple in structure than the eighth embodiment. Thus, the antenna 85 can be thinner and be manufactured at lower cost.

Tenth Embodiment

Figure 32A:
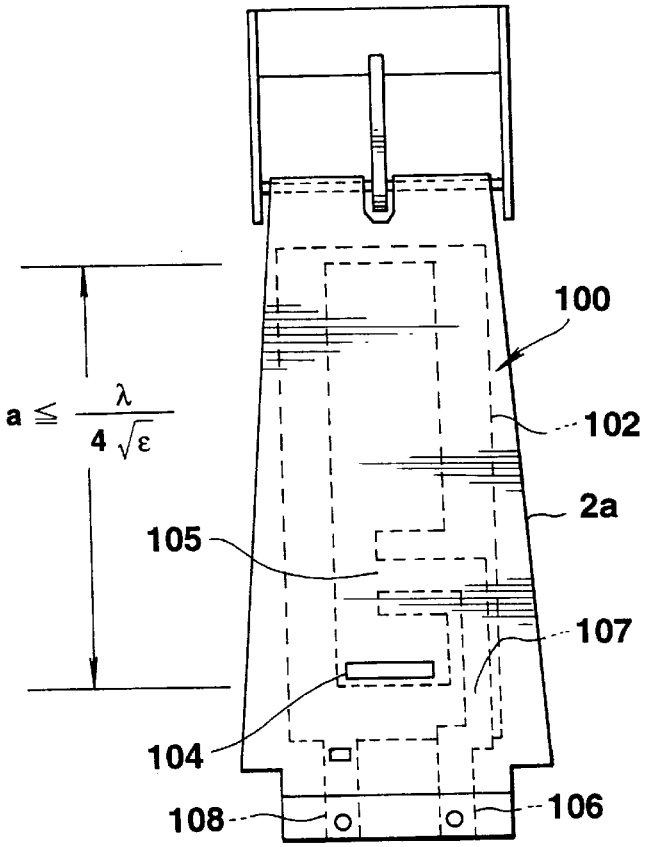
FIGS. 32A and 32B are a front view and partially sectional view of an antenna according to a tenth embodiment of the invention.
Figure 32B:
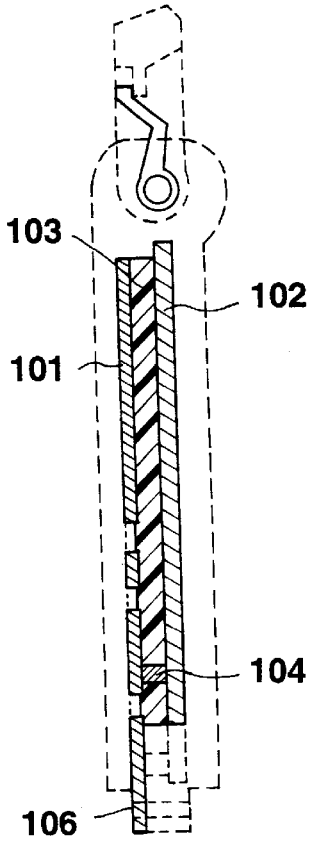
Figure 32C:
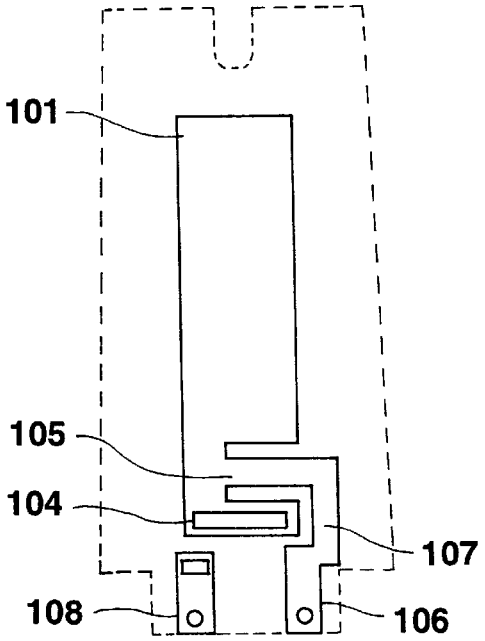
FIGS. 32C and 32D are front views of the antenna shown in FIGS. 32A and 32B, illustrating the layers which constitute the antenna.
Figure 32D:
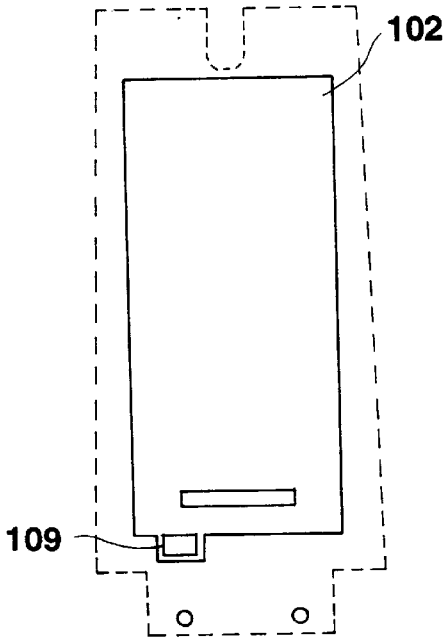

FIGS. 32A and 32B are a front view and partially sectional view of an antenna according to the tenth embodiment of the invention. FIGS. 32C and 32D are front views of this antenna, illustrating the layers which constitute the antenna. The components identical or similar to those shown in FIGS. 28 and 29 are designated at the same reference numerals in FIGS. 32A to 32D and will not be described in detail.

The tenth embodiment is a patch antenna 100, too. Like the eighth and ninth embodiments, the patch antenna 100 is embedded in a band section 2*a* or formed integral therewith and is a three-layer structure. The antenna 100 comprises a patch-shaped conductor 101, a base plate 102 and a dielectric layer 103. The dielectric layer 103 is made of Teflon or the like and sandwiched between the conductor 101 and the base plate 102. (Alternatively, the layer 103 may be made of the same material as the band section 2*a*.) The patch-shaped conductor 101 and the base plate 102 are connected to each other by a conductor strip 104 which passes through the dielectric layer 103. The conductor 101 extends parallel to the axis of the band section 2*a* and has an overall length a ($\leqq\lambda/4\sqrt{\epsilon}$). Power is supplied to the patch-shaped conductor 101 at a point 105 which is displaced a little from the center of the conductor 101 toward the main body (not shown) of a watch-shaped radio apparatus incorporating the patch antenna 100. The antenna 100 further comprises an L-shaped conductor strip 107 which is formed integral with the patch-shaped conductor 101. The first portion of the L-shaped strip 107 is connected to the conductor 101 and extends from the point 105 toward one edge of the band section 2*a*. The second portion of the strip 107 extends toward the main body along that edge of the band section 2*a*. The free end portion of the L-shaped conductor 107 works as a connecting terminal 106.

As shown in FIG. 32C, the patch-shaped conductor 101, the conductor strip 107, the connecting terminal 106, and a connecting terminal 108 are provided in the same plane. The connecting terminal 108 connects the base plate 102 to the radio circuit section (not shown) provided in the main body. As shown in FIG. 32B, the base plate 102 is located below the conductor 101. As shown in FIG. 32D, the base plate 102 has a projection 109, which is connected to the connecting terminal 108. The patch antenna 100 has only two conductive layers (i.e., patch-shaped conductor 101 and base plate 102) and only one insulating layer (i.e., dielectric layer 103) interposed between the conductor layers. The patch antenna 101 is no doubt more simple in structure than the eighth embodiment. The antenna 100 can therefore be thinner and be manufactured at lower cost.

Eleventh Embodiment

Figure 33A:
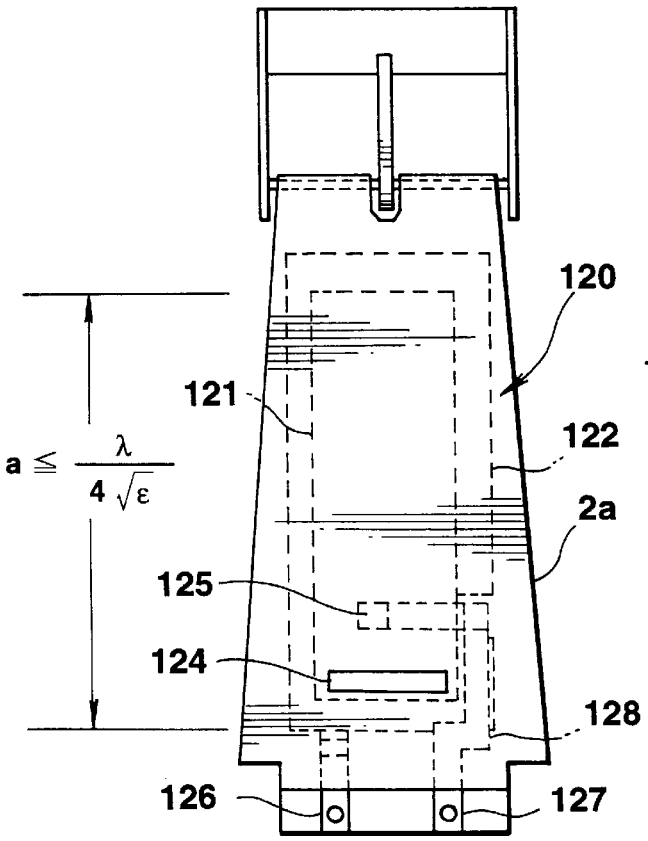
FIGS. 33A and 33B are a front view and partially sectional view of an antenna according to an eleventh embodiment of the invention.
Figure 33B:
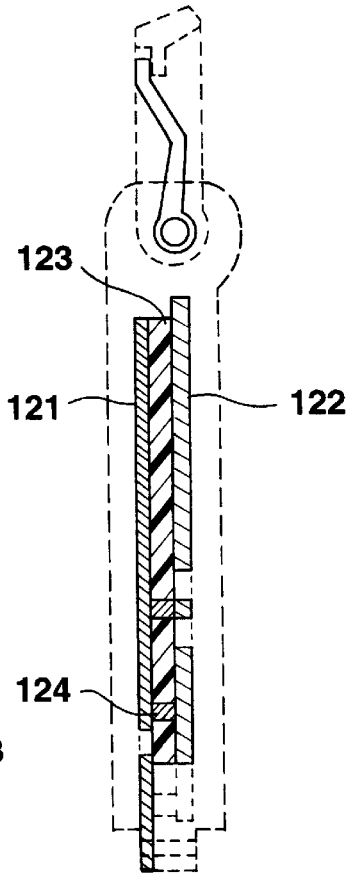
Figure 33C:
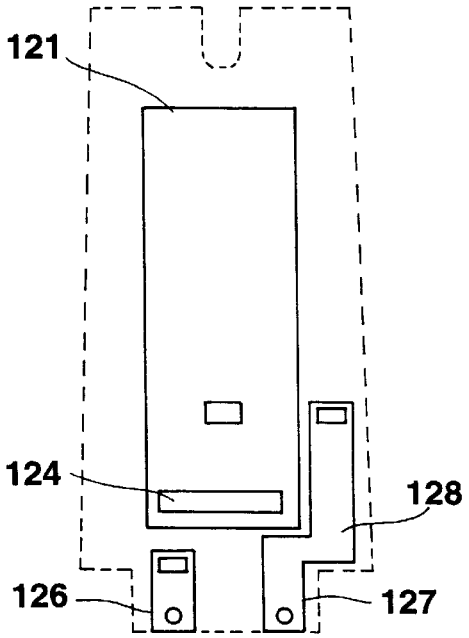
FIGS. 33C and 33D are front views of the antenna shown in FIGS. 33A and 33B, illustrating the layers which constitute the antenna.
Figure 33D:
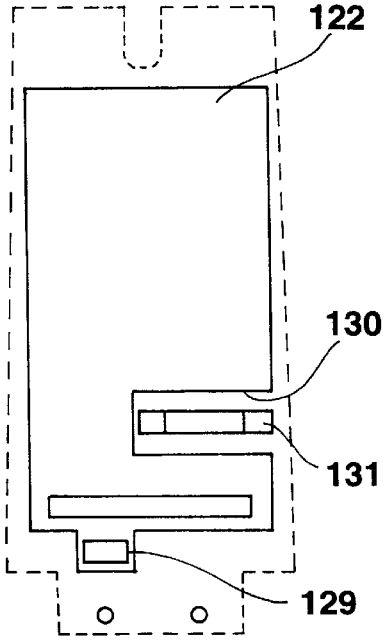

FIGS. 33A and 31B are a front view and partially sectional view of an antenna according to the eleventh embodiment. FIGS. 33C and 33D are front views of this antenna, illustrating the layers which constitute the antenna. The components identical or similar to those shown in FIGS. 28 and 29 are designated at the same reference numerals in FIGS. 33A to 33D and will not be described in detail.

The eleventh embodiment is a patch antenna 120, too. Like the eighth to tenth embodiments, the patch antenna 120 is embedded in a band section 2*a* or formed integral therewith and is a three-layer structure. The antenna 120 comprises a patch-shaped conductor 121, a base plate 122 and a dielectric layer 123. The dielectric layer 123 is made of Teflon or the like and sandwiched between the conductor 121 and the base plate 122. (Alternatively, the layer 123 may be made of the same material as the band section 2*a*.) The patch-shaped conductor 121 and the base plate 122 are connected together by a conductor strip 124 which passes through the dielectric layer 123. The conductor 121 extends parallel to the axis of the band section 2*a* and has an overall length a ($\leqq\lambda/4\sqrt{\epsilon}$). Power is supplied to the patch-shaped conductor 121 at a point 125 which is displaced a little from the center of the conductor 121 toward the main body (not shown) of a watch-shaped radio apparatus incorporating the patch antenna 120. The antenna 120 further comprises a conductor strip 128 which is formed integral with the patch-shaped conductor 121. The conductor strip 128 is aligned at one end with the power-supply point 125, and its other end portion serves as a connecting terminal 127.

As shown in FIG. 33C, the patch-shaped conductor 121, the conductor strip 128, the connecting terminal 127, and a connecting terminal 126 are provided in the same plane. The connecting terminal 126 connects the base plate 102 to the radio circuit section (not shown) provided in the main body. As shown in FIG. 33B, the base plate 122 is located below the conductor 121. As shown in FIG. 33D, the base plate 122 has a projection 129, which is connected to the connecting terminal 126. The patch antenna 120 has only two conductive layers (i.e., patch-shaped conductor 121 and base plate 122) and only one insulating layer (i.e., dielectric layer 123) interposed between the conductor layers. The patch antenna 121 is no doubt more simple in structure than the eighth embodiment. The antenna 120 can therefore be thinner and be manufactured at lower cost.

Portable Radio Apparatuses

Portable radio apparatuses incorporating any one of the patch antennas described above will be described below.

1. Watch-Shaped, FM Stereophonic Radio/FM Teletext Receiver

A watch-shaped, FM stereophonic radio/FM teletext receiver whose receiving antenna is a patch antenna 140 of this invention will be described, with reference to the block diagram of FIG. 34.

Figure 34:
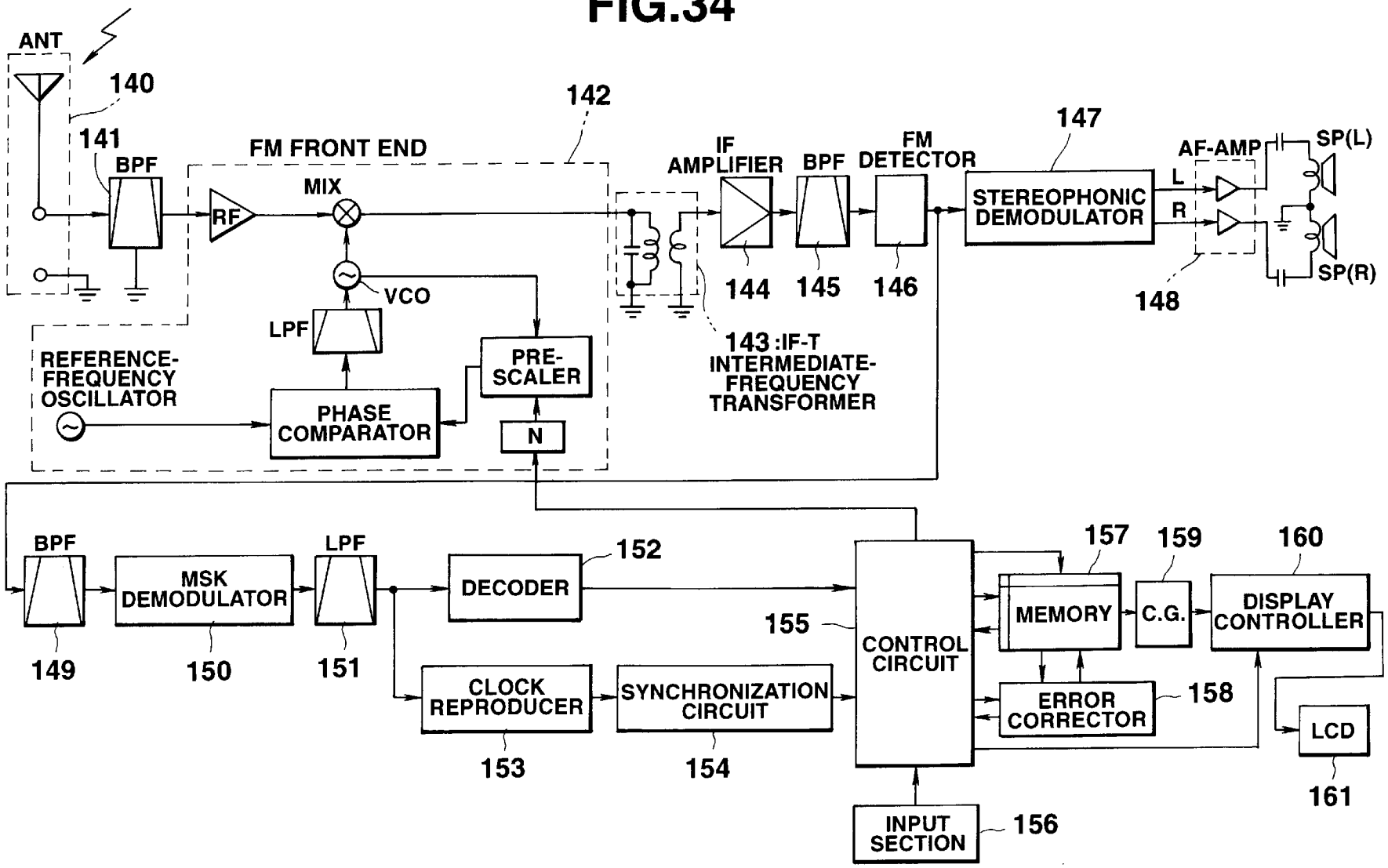
FIG. 34 is a block diagram of a watch-shaped, FM stereophonic radio/FM teletext receiver whose receiving antenna is a patch antenna according to the invention.

As may be understood from FIG. 34, the radio-wave signal the patch antenna 140 has received is supplied via a band-pass filter 141 to an FM font end 142. Controlled by a control circuit 155, the FM front end 142 generates intermediate-frequency (IF) waves. The IF waves are superposed with the radio-wave signal of a desired channel, forming an IF signal. The IF signal is supplied via an IF transformer 143 to an IF amplifier 144. The IF amplifier 144 amplifies the IF signal, which is supplied through a band-pass filter 145 and an FM detector 146 to a stereophonic demodulator 147 and also to a band-pass filter 149. The demodulator 147 demodulates the amplified IF signal into a left (L) audio signal and a right (R) audio signal. The L-audio signal and the R-audio signal are supplied to an audio-frequency (AF) amplifier 148. The AF amplifier 148 amplifies both audio signals, which are supplied to two speakers SP(L) and SP(R), respectively. The speakers SP(L) and SP(R) generates sounds.

In the meantime, the FM mixed signal supplied from the FM detector 146 is supplied to the band-pass filter 149, which extracts a subcarrier multiplex signal. The multiplex signal is supplied to an MSK demodulator 150. The MSK demodulator 150 demodulates the multiplex signal, obtaining text data. The teletext data is supplied via the low-pass filter 151 to a decoder 152 and also to a clock reproducer 153. The decoder 152 decodes the text data, which is supplied to the control circuit 150. The clock reproducer 153 generates a reference clock signal from the teletext data. The reference clock signal is input to a synchronization circuit 154. The circuit 154 generates a sync clock signal, which is supplied to the control circuit 150.

Meanwhile, the control circuit 150 has received from an input section 156 various instructions, including the operating mode selected, instructions for the wave-receiving function and instructions for the watch function. In accordance with these instructions the control circuit 150 supplies data representing the selected channel to the FM front end 142 and controls a memory 157, an error corrector 158 and a display controller 160. The memory 157 stores the text data under the control of the control circuit 155. The error corrector 158 corrects errors, if any, in the text data stored in the memory 157. The text data is supplied from the memory 157 to a character generator 159. The character generator 159 generates character data from the text data. The character data is supplied via the display controller 160 to a liquid crystal display 161. The display 161 displays the character data under the control of the control circuit 155.

2. Watch-Shaped, FM Wireless Microphone/FM Character Code Transmitter

A watch-shaped, FM wireless microphone/FM character code transmitter whose transmitting antenna is a patch antenna 186 according to the present invention will be described, with reference to the block diagram of FIG. 35.

Figure 35:
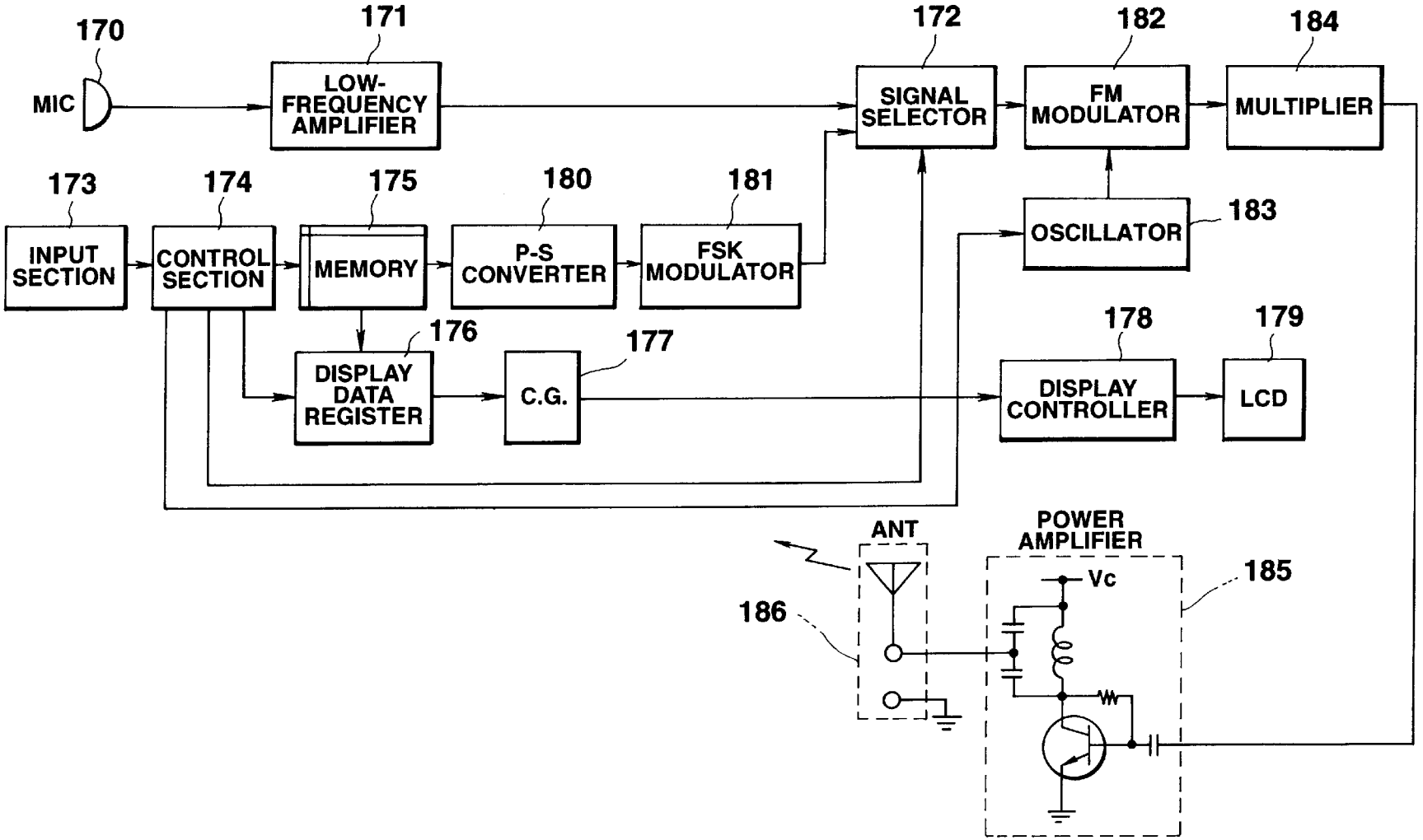
FIG. 35 is a block diagram of a watch-shaped, FM wireless microphone/FM character code transmitter whose transmitting antenna is a patch antenna according to this invention.

As shown in FIG. 35, the audio signal detected by a microphone 170 is amplified by a low-frequency amplifier 171. The signal amplified is supplied to a signal selector 172. In the meantime, text data is supplied from an input section 173 to a control section 174 and hence is stored into a memory 175. The text data is transferred to a display data register 176 under the control of the control circuit 174. The text data is then supplied to a character generator 177. The generator 177 generates character data from the text data. The character data is supplied to a display controller 178, which controls a liquid crystal display 179. Controlled by the controller 178, the display 179 displays the character data.

Meanwhile, the text data input from the input section 173 and stored into the memory 175 is supplied to a parallel-to-serial converter 180. The converter 180 converts the text data to serial data, which is modulated by an FSK modulator 181. The text data thus modulated is supplied the signal selector 172. Controlled by the control section 174, the selector 172 selects the audio signal or the text data. The data selected is supplied to an FM modulator 182, in a predetermined format. The FM modulator 182 modulates the input data with the subcarrier generated by an oscillator 183, thus generating radio waves. The radio waves are multiplied by a multiplier 184 and amplified by a power amplifier 185. The radio waves are then radiated from the patch antenna 186.

3. Watch-Shaped Mobile Telephone

A watch-shaped mobile telephone whose receiving/transmitting antenna is a patch antenna 190 according to the present invention will be described, with reference to the block diagram of FIG. 36.

Figure 36:
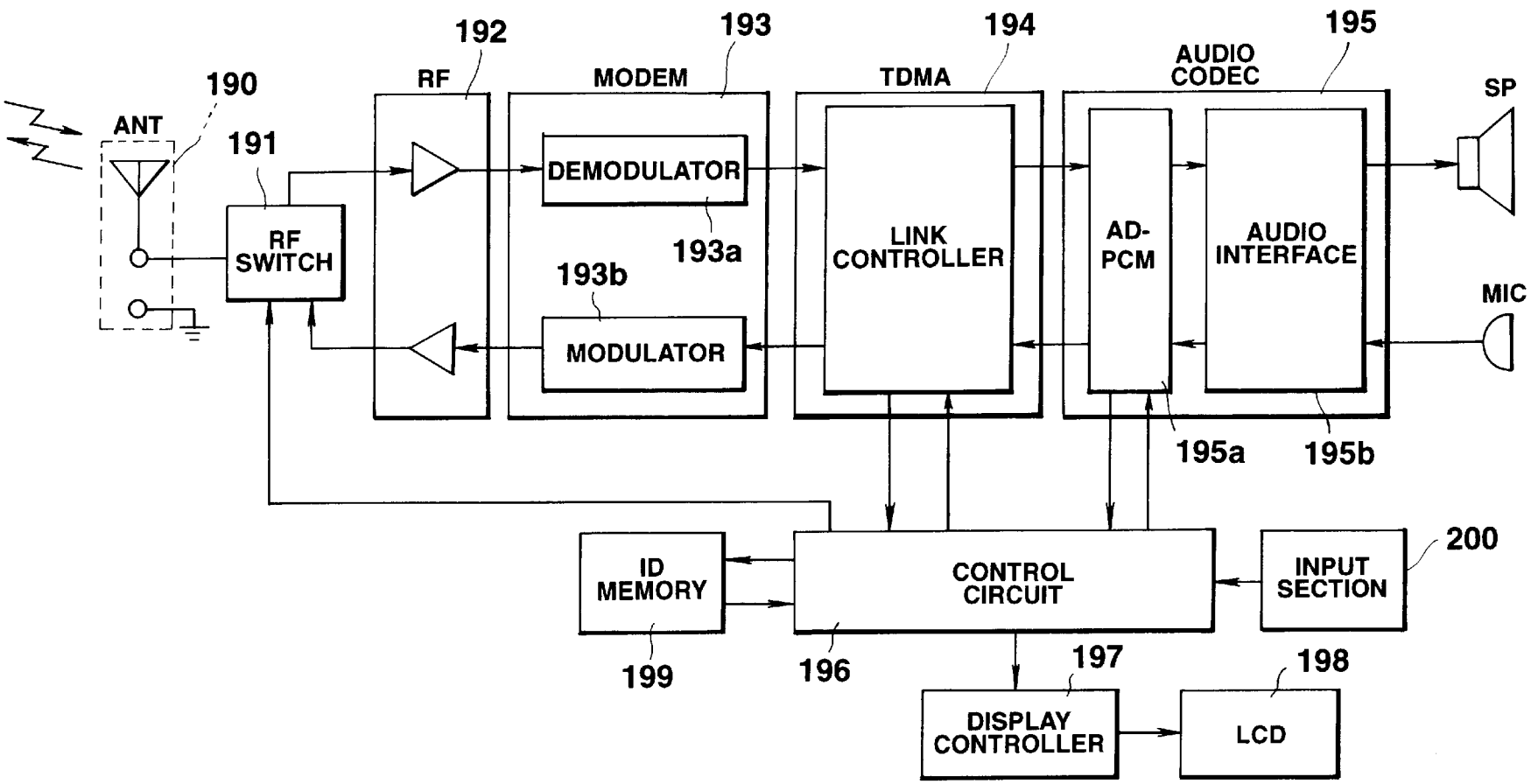
FIG. 36 is a block diagram of a watch-shaped mobile telephone whose receiving/transmitting antenna is a patch antenna according to the invention.

As illustrated in FIG. 36, the signal the antenna 190 has received is supplied through an RF (radio-frequency) switch 191 to an RF converter 192. The RF converter 192 mixes the signal with a local signal of a prescribed frequency output by a PLL synthesizer (not shown), thereby generating an IF signal of 1.9 to 1 MHz. The IF signal is supplied to the demodulator 193*a* of a modem 193. The demodulator 193*a* demodulates the IF signal, producing a stream of IQ data items. The IQ data stream is supplied to a TDMA link controller 194. The receiving section of the link controller 194 extracts one slot of data from the IQ data stream at a predetermined time. Further, the receiving section extracts a unique word (i.e., a sync signal) from the data slot, thereby generating a frame sync signal. The receiving section also descrambles the control data and audio data contained in the data slot. The descrambled control data is supplied to an audio codec 195. In the audio codec 195, the AD-PCM decoder 195*a* expands the AD-PCM audio signal (4 bit×8 KHz=32 Kbps) supplied from the TDMA link controller 194, into a PCM audio signal (8 bits×8 MHz=64 Kbps). Also in the audio code 195, the audio interface 195*b* converts the PCM audio signal to an analog audio signal. The analog audio signal is supplied to a speaker SP, which generates sound.

On the other hand, the audio signal input from a microphone MIC is supplied to the audio interface 195*b* of the audio codec 195. The audio interface 195*b* converts the audio signal to a digital audio signal, which is supplied to the AD-PCM decoder 195*a*. The decoder 195*a* compresses the digital audio signal, forming ADPCM audio data. The ADPCM data is supplied to the TDMA link controller 194. The transmitting section of the TDMA link controller 194 adds control data and the like to the audio data supplied from the audio codec 195, then scrambles the audio data and finally adds a unique word to the scrambled audio data, thereby providing a one-slot data to be transmitted. The one-slot data is supplied to the modem 193. In the modem 193, the modulator 193*b* generates IQ data from the data supplied from the TDMA link controller 194 and performs $\lambda/4$ shift QPSK modulation on the IQ data. The IQ data thus modulated is supplied to the RF converter 192. The transmitting section of the RF converter 192 mixes the IQ data with the local signal output by the PLL synthesizer (not shown), thereby generating an IF signal of 1.9 to 1 MHz. The IF signal is supplied via the RF switch 190 to the patch antenna 190. The patch antenna 190 radiates radio waves of 1.9 to 1 MHz.

The RF switch 191, TDMA channel link controller 192, audio codec 195 and the like, all described above, are controlled by a control circuit 196. Connected to the control circuit 196 are a display controller 197, an ID memory 199 and an input section 200. The control circuit 196 supplies display data to the display controller 197, whereby a liquid crystal display 198 displays the data. The ID memory 199 stores ID data identifying the authorized user of the watch-shaped mobile telephone. The input section 200 comprises numeral keys, an on/off hook switch, a volume switch and the like. When these keys and switches are operated, data is generated. The data thus generated is supplied to the control circuit 196.

As described above, the patch antennas according to the present invention can be used in combination with watch-shaped radio apparatuses, such as a watch-shaped, FM stereophonic radio/FM teletext receiver, a watch-shaped, FM wireless microphone/FM character code transmitter and a watch-shaped mobile telephone whose receiving/transmitting antenna.

What is claimed is:

1. A band antenna for use in a portable radio apparatus, comprising:

a main body provided with a radio wave circuit;

flexible power-fed antenna element conductors symmetrically arranged with respect to the main body and fed with power from the main body such that current distributions flowing along the length direction thereof are symmetrical with respect to the main body;

flexible non-power-fed antenna element conductors symmetrically arranged with respect to the main body; and a band section provided with a buckle and holes for securing the apparatus to a user, the power-fed and non-power-fed antenna element conductors are embedded in the band section such that the holes are between the power-fed and non-power-fed antenna element conductors;

wherein each of said non-power-fed element conductors is shorter than each of said power-fed antenna element conductors and operates as a director.

2. A band antenna for use in a portable radio apparatus, comprising:

a main body provided with a radio wave circuit;

flexible power-fed antenna element conductors symmetrically arranged with respect to the main body and fed with power from the main body such that current distributions flowing along the length direction thereof are symmetrical with respect to the main body;

flexible non-power-fed antenna element conductors symmetrically arranged with respect to the main body; and a band section provided with a buckle and holes for securing the apparatus to a user, the power-fed and non-power-fed antenna element conductors are embedded in the band section such that the holes are between the power-fed and non-power-fed antenna element conductors;

wherein each of said non-power-fed antenna element conductors is longer than each of said power-fed antenna element conductors and operates as a reflector.

3. A band antenna for use in a portable radio apparatus, comprising:

a main body provided with a radio wave circuit;

flexible power-fed antenna element conductors symmetrically arranged with respect to the main body and fed with power from the main body such that current distributions flowing along the length direction thereof are symmetrical with respect to the main body;

flexible non-power-fed antenna element conductors spaced apart from said power-fed antenna element conductors and having a diameter or a width different from the power-fed antenna element conductors;

wherein the power-fed antenna element conductors and the non-power-fed antenna element conductors are connected at one end, constituting a folded antenna; and a band section provided with a buckle and holes for securing the apparatus to a user, the folded antenna is embedded in the band section such that holes are arranged between the power-fed antenna element conductors and the non-power-fed antenna element conductors.

4. The antenna according to claim 3, wherein said non-power-fed antenna element conductors are one to six times as thick or wide as said power-fed antenna element conductors.

5. The antenna according to claim 3, wherein said non-power-fed antenna element conductors are formed integral with said power-fed antenna element conductors.

6. A band antenna for use in a portable radio apparatus, comprising:

a main body provided with a radio wave circuit;

flexible power-fed antenna element conductors symmetrically arranged with respect to the main body and fed with power from the main body such that current distributions flowing along the length direction thereof are symmetrical with respect to the main body;

first flexible non-power-fed antenna element conductors spaced apart from said power-fed antenna element conductors and having a diameter or a width different from the power-fed antenna element conductors;

wherein the power-fed antenna element conductors and the non-power-fed antenna element conductors are connected at one end, constituting a folded antenna;

second flexible non-power-fed antenna element conductors shorter than the folded antenna; and a band section provided with a buckle and holes for securing the apparatus to a user, the folded antenna and the second non-power-fed antenna element conductors are embedded in the band section such that holes are arranged between the folded antenna and the second non-power-fed antenna element conductors.

7. The antenna according to claim 6, wherein said non-power-fed antenna element conductors are one to six times as thick or wide as said power-fed antenna element conductors.

8. The antenna according to claim 6, wherein said first non-power-fed antenna element conductors are formed integral with said power-fed antenna element conductors.

9. The antenna according to claim 6, further comprising second non-power-fed antenna element conductors which are 0.8 to 0.9 times as long as said folded antenna and which are spaced apart from said folded antenna, extend parallel thereto and are spaced apart therefrom by a distance which is 0.2 to 1.5 times a quarter-wave length.

10. An antenna for use in a portable radio apparatus, comprising:

a band section for securing a main body provided with a radio wave circuit to a user;

a patch conductor plate and a base plate conductor plate comprising a base plate are provided within the band section, the patch conductor plate and the base plate conductor plate sandwiching a dielectric from a front surface and a rear surface of the band;

a short-circuiting portion which short-circuits the patch conductor plate and the base plate conductor plate; and a power feeding portion to feed power to each of the patch conductor plate and the base plate conductor plate;

wherein the patch conductor plate and the base plate conductor plate serve as an inverted-F antenna.

11. The antenna according to claim 10, wherein said short-circuiting portion short-circuits the patch conductor plate and the base plate conductor plate are short-circuited to each other at one end portion;

the power feeding portion feeds power at substantially mid point of the patch conductor plate and the base plate conductor plate; and wherein a distance between the short-circuited portion of the patch conductor plate and the base plate conductor plate and the other end thereof is a quarter-wave length or less.

12. The antenna according to claim 11, wherein the patch conductor plate has the other end portion of the short-circuited portion bent in a direction of the base plate conductor plate;

the power feeding portion feeds power at substantially mid point of the patch conductor plate and the base plate conductor plate.

13. An antenna for use in a portable radio apparatus, comprising:

a band section, including a dielectric, for securing a main body provided with a radio wave circuit to a user;

a first conductive layer having a patch conductor within the band section made of a dielectric;

a second conductive layer having a base plate which has a through hole at a power feeding point where power is fed to said first conductive layer;

a short-circuiting portion short-circuiting the first and second conductive layers electrically;

a first dielectric layer interposed between said first and second conductive layers;

a third conductive layer having a conductor strip for feeding power to the power feeding point;

and wherein the second and third conductive layers are separated at a second dielectric layer formed by a part of the band section made of a dielectric.

* * * * *